US010507649B2

(12) United States Patent
Tada

(10) Patent No.: US 10,507,649 B2
(45) Date of Patent: Dec. 17, 2019

(54) LIQUID DISCHARGE APPARATUS AND PRINT HEAD

(71) Applicant: SEIKO EPSON CORPORATION, Tokyo (JP)

(72) Inventor: Keiichi Tada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/140,994

(22) Filed: Sep. 25, 2018

(65) Prior Publication Data

US 2019/0092000 A1 Mar. 28, 2019

(30) Foreign Application Priority Data

Sep. 27, 2017 (JP) ..... 2017-185855
Feb. 21, 2018 (JP) ..... 2018-029046

(51) Int. Cl.
*B41J 2/045* (2006.01)

(52) U.S. Cl.
CPC ..... *B41J 2/04541* (2013.01); *B41J 2/0455* (2013.01); *B41J 2/04581* (2013.01)

(58) Field of Classification Search
CPC ..... B41J 2/04541; B41J 2/0455
See application file for complete search history.

(56) References Cited

U.S. PATENT DOCUMENTS

2002/0145637 A1 10/2002 Umeda et al.
2003/0227518 A1 12/2003 Murai et al.
2005/0078153 A1 4/2005 Murai et al.
2005/0088490 A1* 4/2005 Mita ..... B41J 2/14233 347/68

FOREIGN PATENT DOCUMENTS

JP 02-141245 A 5/1990
JP 3711447 B2 11/2005
JP 4530615 B2 8/2010

* cited by examiner

*Primary Examiner* — Julian D Huffman
(74) *Attorney, Agent, or Firm* — Global IP Counselors, LLP

(57) ABSTRACT

A liquid discharge apparatus includes a piezoelectric element that has a first electrode, a piezoelectric body, and a second electrode, a first switch that is capable of switching whether to supply a drive signal for driving the piezoelectric element to the first electrode, and a second switch that is arranged electrically in parallel with the piezoelectric element and is capable of switching whether to electrically connect the first electrode and the second electrode to each other.

17 Claims, 17 Drawing Sheets

FIG. 9

| Sd[m] | Sd[m] SPECIFICATION CONTENT | SLa[m] | | SLb[m] | |
|---|---|---|---|---|---|
| | | TP1 | TP2 | TP1 | TP2 |
| (1, 1) | LARGE-SIZED DOT | H | H | L | L |
| (1, 0) | MIDDLE-SIZED DOT | H | L | L | L |
| (0, 1) | SMALL-SIZED DOT | L | H | L | L |
| (0, 0) | NON-RECORDING | L | L | H | H |

LIQUID DISCHARGE APPARATUS AND PRINT HEAD

The entire disclosure Japanese Patent Application No. 2017-185855 filed Sep. 27, 2017 and No. 2018-029046 filed Feb. 21, 2018 are expressly incorporated herein by reference.

BACKGROUND

1. Technical Field

The present invention relates to a liquid discharge apparatus and a print head.

2. Related Art

A liquid discharge apparatus such as an ink jet printer executes print processing of driving a plurality of discharge portions provided on a recording head and displacing piezoelectric elements of the respective discharge portions to discharge liquid such as ink with which cavities (pressure chambers) of the respective discharge portions provided on a print head are filled and form an image on a recording media.

The piezoelectric elements of the respective discharge portions have upper electrodes, lower electrodes, and piezoelectric bodies provided between the upper electrodes and the lower electrodes. The piezoelectric elements are displaced by, for example, supplying a drive signal to the upper electrodes and applying a voltage in accordance with the drive signal to between the upper electrodes and the lower electrodes.

The piezoelectric bodies of the piezoelectric elements are generally formed as polycrystal bodies and directions of spontaneous polarization of individual microcrystals are non-uniform as they are when formed. For coping with this, piezoelectric characteristics are given by poling of making the polarization directions uniform by application of a direct-current (DC) electric field (for example, see JP-A-2-141245).

In recent years, piezoelectric elements use thin-film piezoelectric bodies in many cases. Discharge portions including the piezoelectric elements using the thin-film piezoelectric bodies can be manufactured by the MEMS (micro electro mechanical systems) technique (for example, see Japanese Patent No. 4530615).

A technique of setting potentials of the lower electrodes of the piezoelectric elements to a predetermined potential differing from a ground potential has been proposed (for example, see Japanese Patent No. 3711447). Such a technique is effective for suppressing leak current between the upper electrodes and the lower electrodes and is particularly effective in the piezoelectric elements using the thin-film piezoelectric bodies in which leak current is easily generated.

In driving of the piezoelectric elements, when an electric field having polarity reverse to that in the poling is applied to between the upper electrodes and the lower electrodes, the polarization directions of the piezoelectric bodies are disturbed and the piezoelectric characteristics may be lowered, or the piezoelectric bodies may be broken. In particular, the thin-film piezoelectric bodies are easily broken due to application of the electric field having the polarity reverse to that in the poling. Setting of the potentials of the lower electrodes of the piezoelectric elements to the predetermined potentials differing from the ground potential can make the electric field having the polarity reverse to that in the poling easy to be applied between the upper electrodes and the lower electrodes in some cases.

SUMMARY

An advantage of some aspects of the invention is to provide a technique capable of suppressing application of an electric field having polarity reverse to that in poling to a piezoelectric element in a print head provided in a liquid discharge apparatus.

A liquid discharge apparatus according to an aspect of the invention includes a piezoelectric element that has a first electrode, a piezoelectric body, and a second electrode, a first switch that is capable of switching whether to supply a drive signal for driving the piezoelectric element to the first electrode, and a second switch that is arranged electrically in parallel with the piezoelectric element and is capable of switching whether to electrically connect the first electrode and the second electrode to each other.

With this aspect, the second switch is capable of switching whether to electrically connect the first electrode and the second electrode to each other. Therefore, application of a reverse-polarity electric field (electric field having polarity reverse to that in poling of the piezoelectric body) to the piezoelectric element can be suppressed in comparison with the case in which the first electrode and the second electrode cannot be electrically connected to each other.

In the above-described liquid discharge apparatus according to the aspect of the invention, the piezoelectric element is formed as a polycrystal body and is subject to poling.

With this aspect, application of the reverse-polarity electric field to the piezoelectric element that is easily broken and lowered in piezoelectric characteristics due to the reverse-polarity electric field because of formation of the piezoelectric element as the polycrystal body and the poling performed thereon can be suppressed.

In the above-described liquid discharge apparatus according to the aspect of the invention, the second switch switches whether to electrically connect the first electrode and the second electrode to each other so as not to change a magnitude relation between a potential of the first electrode and a potential of the second electrode.

With this aspect, reversing of the polarity of the electric field that is applied to the piezoelectric element is suppressed, thereby suppressing application of the reverse-polarity electric field to the piezoelectric element.

In the above-described liquid discharge apparatus according to the aspect of the invention, a potential of the second electrode is set to be a first potential that is higher than a ground potential.

With this aspect, even when the reverse-polarity electric field is easily applied due to setting of the potential of the second electrode to the first potential, application of the reverse-polarity electric field to the piezoelectric element can be suppressed.

In the above-described liquid discharge apparatus according to the aspect of the invention, the second switch electrically connects the first electrode and the second electrode to each other when a potential of the first electrode is lower than a potential of the second electrode.

With this aspect, application of the reverse-polarity electric field to the piezoelectric element can be suppressed.

The above-described liquid discharge apparatus according to the aspect of the invention further includes a comparison unit that compares a potential of the first electrode and a potential of the second electrode, wherein the second switch switches whether to electrically connect the first electrode and the second electrode to each other in accordance with a comparison result by the comparison unit.

With this aspect, application of the reverse-polarity electric field to the piezoelectric element can be suppressed.

In the above-described liquid discharge apparatus according to the aspect of the invention, in a first period, a waveform for driving the piezoelectric element is set to the drive signal, the first switch is set to be in a state of supplying the drive signal to the first electrode, and the second switch is set to be in a state of electrically disconnecting the first electrode and the second electrode from each other, and in a second period other than the first period, the first switch is set to be in a state of supplying no drive signal to the first electrode, and the second switch is set to be in a state of electrically connecting the first electrode and the second electrode to each other.

With this aspect, in the first period, the drive signal having the waveform for driving the piezoelectric element can be supplied to the piezoelectric element to drive the piezoelectric element, whereas in the second period, application of the reverse-polarity electric field to the piezoelectric element can be suppressed.

In the above-described liquid discharge apparatus according to the aspect of the invention, the second switch electrically connects the first electrode and the second electrode to each other when a state in which the potential of the first electrode is lower than the potential of the second electrode lasts for a first time length.

With this aspect, application of the reverse-polarity electric field to the piezoelectric element for an excessively long period of time can be suppressed.

The above-described liquid discharge apparatus according to the aspect of the invention further includes a delay unit that delays a first signal indicating whether the potential of the first electrode is lower than the potential of the second electrode at first timing to second timing the first time length after the first timing, wherein the second switch electrically connects the first electrode and the second electrode to each other whether both of the first signal delayed to the second timing and a second signal indicating whether the potential of the first electrode is lower than the potential of the second electrode at the second timing indicate that the potential of the first electrode is lower than the potential of the second electrode.

With this aspect, application of the reverse-polarity electric field to the piezoelectric element for an excessively long period of time can be suppressed.

In the above-described liquid discharge apparatus according to the aspect of the invention, the second switch electrically connects the first electrode and the second electrode to each other when the potential of the first electrode is set to be lower than a second potential that is set to be lower than the potential of the second electrode.

With this aspect, application of an excessively high reverse-polarity electric field to the piezoelectric element can be suppressed.

A liquid discharge apparatus according to another aspect of the invention includes a piezoelectric element that has a first electrode, a piezoelectric body, and a second electrode, and a first switch that is capable of switching whether to electrically connect a wiring for supplying a drive signal for driving the piezoelectric element and the first electrode to each other, wherein in a first period, a waveform for driving the piezoelectric element is set to the drive signal, and the first switch is set to be in a state of electrically connecting the wiring and the first electrode to each other, and in a second period other than the first period, a potential equal to a potential of the second electrode is set to the drive signal, and the first switch is set to be in a state of electrically connecting the wiring and the first electrode to each other.

With this aspect, in the second period, the drive signal having the potential set to be equal to the potential of the second electrode is supplied to the first electrode and the potential of the first electrode and the potential of the second electrode are set to be equal to each other, thereby suppressing application of a reverse-polarity electric field to the piezoelectric element.

In the above-described liquid discharge apparatus according to the aspect of the invention, discharge portions that include piezoelectric elements using thin-film piezoelectric bodies and are capable of discharging liquid are aligned with a density equal to or higher than 300 dpi.

With this aspect, a liquid discharge apparatus that suppresses application of the reverse-polarity electric field to the piezoelectric elements using the thin-film piezoelectric bodies and in which the discharge portions are aligned with a high density is realized.

The high density indicates a state in which 300 or more discharge portions are aligned per inch. In order to ensure a displacement amount for discharging in the state in which the discharge portions are aligned with high density, the piezoelectric elements need to be reduced in thickness.

A print head according to still another aspect of the invention includes a piezoelectric element that has a first electrode, a piezoelectric body, and a second electrode, a first switch that is capable of switching whether to supply a drive signal for driving the piezoelectric element to the first electrode, and a second switch that is arranged electrically in parallel with the piezoelectric element and is capable of switching whether to electrically connect the first electrode and the second electrode to each other.

With this aspect, the second switch is capable of switching whether to electrically connect the first electrode and the second electrode to each other. Therefore, application of a reverse-polarity electric field (electric field having polarity reverse to that in poling of the piezoelectric body) to the piezoelectric element can be suppressed in comparison with the case in which the first electrode and the second electrode cannot be electrically connected to each other.

In the above-described print head according to the aspect of the invention, the piezoelectric element is formed as a polycrystal body and is subject to poling.

With this aspect, application of the reverse-polarity electric field to the piezoelectric element that is easily broken and lowered in piezoelectric characteristics due to the reverse-polarity electric field because of formation of the piezoelectric element as the polycrystal body and the poling performed thereon can be suppressed.

In the above-described print head according to the aspect of the invention, the second switch switches whether to electrically connect the first electrode and the second electrode to each other so as not to change a magnitude relation between a potential of the first electrode and a potential of the second electrode.

With this aspect, reversing of the polarity of the electric field that is applied to the piezoelectric element is suppressed, thereby suppressing application of the reverse-polarity electric field to the piezoelectric element.

In the above-described print head according to the aspect of the invention, a potential of the second electrode is set to be a first potential that is higher than a ground potential.

With this aspect, even when the reverse-polarity electric field is easily applied due to setting of the potential of the second electrode to the first potential, application of the reverse-polarity electric field to the piezoelectric element can be suppressed.

In the above-described print head according to the aspect of the invention, the second switch electrically connects the first electrode and the second electrode to each other when a potential of the first electrode is lower than a potential of the second electrode.

With this aspect, application of the reverse-polarity electric field to the piezoelectric element can be suppressed.

The above-described print head according to the aspect of the invention further includes a comparison unit that compares a potential of the first electrode and a potential of the second electrode, wherein the second switch switches whether to electrically connect the first electrode and the second electrode to each other in accordance with a comparison result by the comparison unit.

With this aspect, application of the reverse-polarity electric field to the piezoelectric element can be suppressed.

BRIEF DESCRIPTION OF THE DRAWINGS

The invention will be described with reference to the accompanying drawings, wherein like numbers reference like elements.

FIG. 9 is a descriptive view for explaining an example of a relation between an individual specification signal and a connection state specification signal in the print processing.

DESCRIPTION OF EXEMPLARY EMBODIMENTS

Hereinafter, modes for carrying out the invention will be described with reference to the drawings. It should be noted that dimensions and scales of respective parts are appropriately made different from actual ones. Furthermore, embodiments, which will be described below, are preferable specific examples of the invention and therefore have various limitations that are technically preferable but the scope of the invention is not limited to these embodiments unless a description limiting the invention is particularly given in the following explanation.

A. First Embodiment

In the embodiment, a liquid discharge apparatus is described using, as an example, an ink jet printer that discharges ink (an example of "liquid") to form an image on recording paper PP (an example of a "medium").

1. Outline of an Ink Jet Printer

Figure 1:
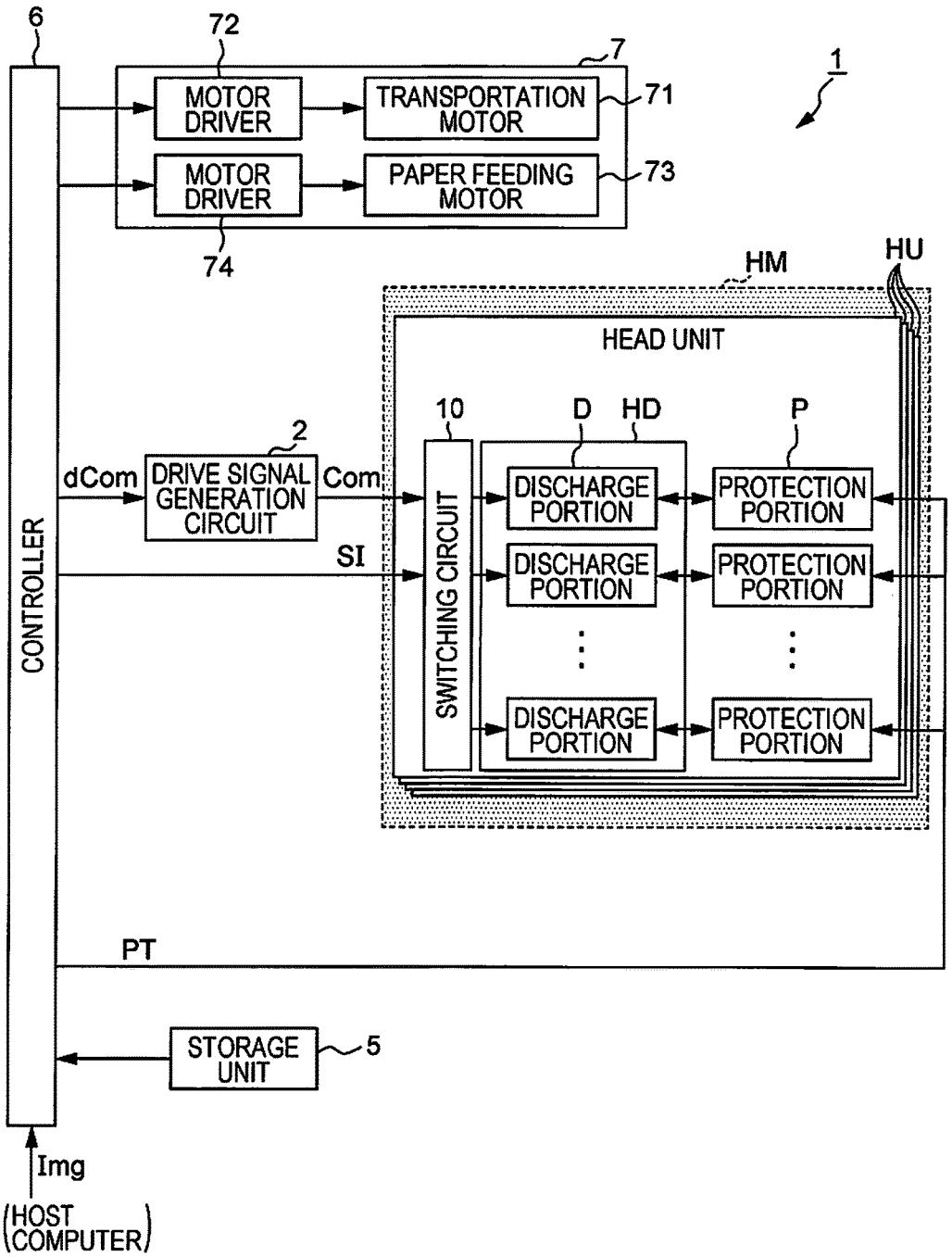
FIG. 1 is a block diagram illustrating an example of the configuration of an ink jet printer according to a first embodiment of the invention.
Figure 2:
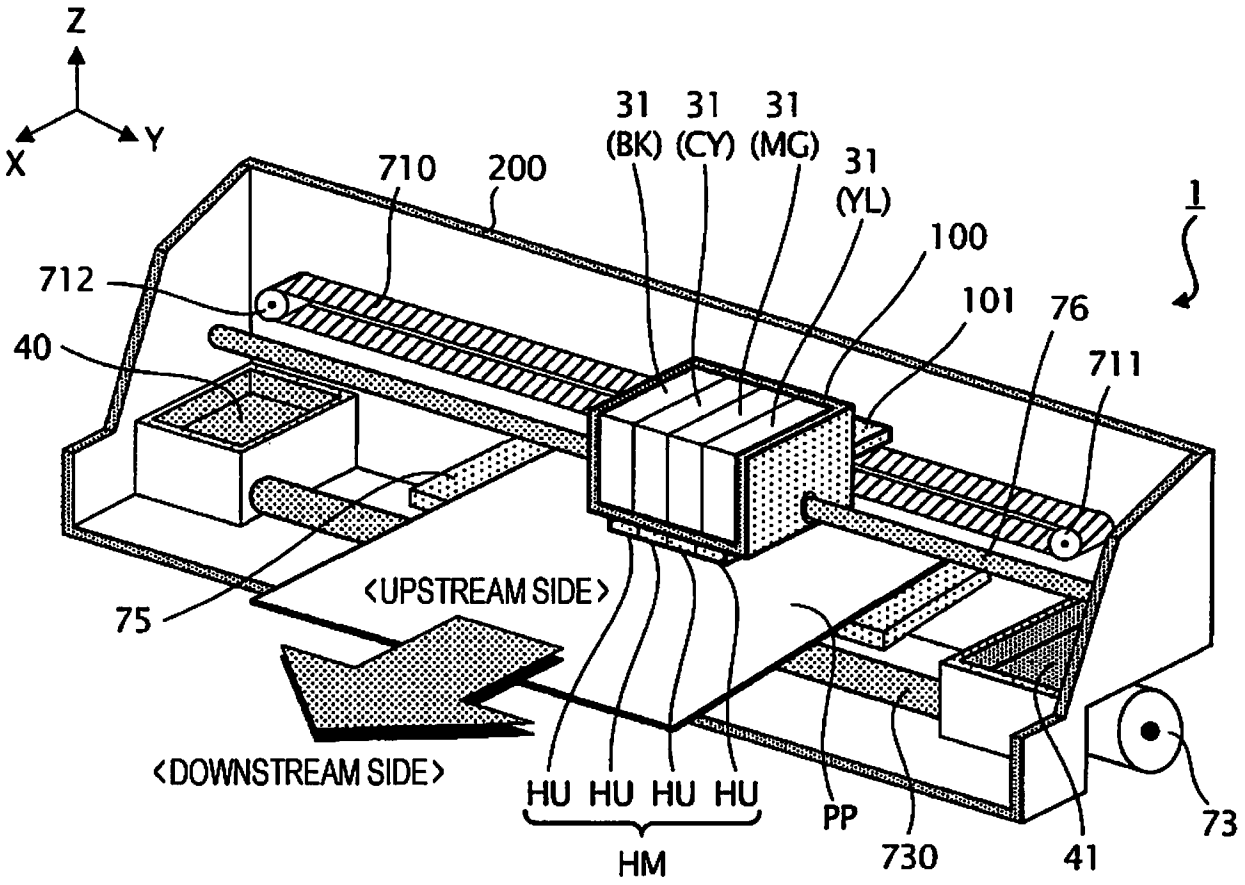
FIG. 2 is a perspective view illustrating an example of the schematic internal configuration of the ink jet printer.

The configuration of the ink jet printer 1 according to the embodiment will be described with reference to FIG. 1 and FIG. 2. FIG. 1 is a block diagram illustrating an example of the configuration of the ink jet printer 1 according to the embodiment. FIG. 2 is a perspective view illustrating an example of the schematic internal configuration of the ink jet printer 1.

Print data Img indicating an image that the ink jet printer 1 should form and copy number information CP indicating the number of print copies of the image that the ink jet printer 1 should form are supplied to the ink jet printer 1 from a host computer such as a personal computer, a digital camera, and the like. The ink jet printer 1 executes print processing for forming, on the recording paper PP, the image indicated by the print data Img supplied from the host computer.

As illustrated in FIG. 1, the ink jet printer 1 includes a head module HM that has head units HU (an example of a "print head") provided with discharge portions D for discharging inks, a controller 6 that controls respective parts of the ink jet printer 1, a drive signal generation circuit 2 (an example of a "drive signal generator") that generates a drive signal Com for driving the discharge portions D, a transportation mechanism 7 that changes a position of the recording paper PP relative to the head module HM, and a storage unit 5 that stores therein a control program of the ink jet printer 1 and other pieces of information.

In the embodiment, as illustrated in FIG. 1, it is supposed that the head module HM includes four head units HU.

In the embodiment, each head unit HU includes a recording head HD having M discharge portions D, a switching circuit 10 (an example of a "switching portion"), and protection portions P provided so as to correspond to the respective discharge portions D of the recording head HD (in the embodiment, M is a natural number satisfying 2≤M).

Hereinafter, in order to distinguish the M discharge portions D provided on each recording head HD from one another, the discharge portions D are in some cases referred to as a first stage, a second stage, . . . , and an Mth stage in that order. The discharge portion D of an mth stage is referred to as a discharge portion D[m] in some cases (a variable m is a natural number satisfying 1≤m≤M). When constituent components of the ink jet printer 1, signals, and the like correspond to the stage number m of the discharge portion D[m], a suffix [m] indicating correspondence to the stage number m is added to each of reference numerals for representing the constituent components, the signals, and the like for representation. For example, the protection portion P provided so as to correspond to the discharge portion D[m] of the stage number m is represented by P[m] in some cases.

The switching circuit 10 switches whether to supply the drive signal Com output from the drive signal generation circuit 2 to the respective discharge portions D. The protection portions P switch whether to electrically connect upper electrodes Zu and lower electrodes Zd of piezoelectric elements PZ (see FIG. 3A for the piezoelectric elements PZ) provided on the respective discharge portions D to each other.

In the embodiment, the ink jet printer 1 is presumed to be a serial printer, as an example. To be specific, the ink jet printer 1 executes the print processing by discharging the inks from the discharge portions D while transporting the recording paper PP in a sub-scanning direction and moving the head module HM in a main-scanning direction. In the embodiment, as illustrated in FIG. 2, it is assumed that a +Y direction and a −Y direction as an opposite direction thereto (hereinafter, the +Y direction and the −Y direction are collectively referred to as a "Y-axis direction") are the main-scanning direction and a +X direction (hereinafter, the +X direction and a −X direction as an opposite direction thereto are collectively referred to as an "X-axis direction") is the sub-scanning direction.

As illustrated in FIG. 2, the ink jet printer 1 according to the embodiment includes a housing 200 and a carriage 100 that can reciprocate in the Y-axis direction in the housing 200 and on which the head module HM is mounted.

When the print processing is executed, the transportation mechanism 7 causes the carriage 100 to reciprocate in the Y-axis direction and transports the recording paper PP in the +X direction to change the position of the recording paper PP relative to the head module HM and enable the ink to land on the recording paper PP overall.

As illustrated in FIG. 1, the transportation mechanism 7 includes a transportation motor 71 as a drive source for causing the carriage 100 to reciprocate in the Y-axis direction, a motor driver 72 for driving the transportation motor 71, a paper feeding motor 73 as a drive source for transporting the recording paper PP, and a motor driver 74 for driving the paper feeding motor 73. As illustrated in FIG. 2, the transportation mechanism 7 includes a carriage guide shaft 76 extending in the Y-axis direction and a timing belt 710 wound around a pulley 711 that is rotationally driven by the transportation motor 71 and a rotatable pulley 712 and extending in the Y-axis direction. The carriage 100 is supported by the carriage guide shaft 76 so as to reciprocate in the Y-axis direction, and is fixed to a predetermined place of the timing belt 710 with a fixture 101 interposed therebetween. Therefore, the transportation mechanism 7 can move the head module HM mounted on the carriage 100 in the Y-axis direction along the carriage guide shaft 76 by rotationally driving the pulley 711 by the transportation motor 71.

Furthermore, as illustrated in FIG. 2, the transportation mechanism 7 includes a platen 75 provided at the lower side, that is, at a −Z direction (hereinafter, the −Z direction and a +Z direction as an opposite direction thereto are collectively referred to as a "Z-axis direction") side relative to the carriage 100, a paper feeding roller (not illustrated) that rotates in accordance with driving of the paper feeding motor 73 and supplies the recording paper PP one by one onto the platen 75, and a paper discharge roller 730 that rotates in accordance with driving of the paper feeding motor 73 and transports the recording paper PP on the platen 75 to a paper discharge port. The transportation mechanism 7 can therefore transport the recording paper PP from the −X direction (upstream side) to the +X direction (downstream side) on the platen 75.

In the embodiment, as illustrated in FIG. 2, four ink cartridges 31 corresponding, one to one, to inks of four colors (CMYK) of CY (cyan), MG (magenta), YL (yellow), and BK (black) are presumed to be accommodated in the carriage 100. It should be noted that FIG. 2 is merely an example and the ink cartridges 31 may be provided on the outside of the carriage 100.

In the embodiment, the four head units HU and the four ink cartridges 31 are provided in a one-to-one correspondence manner. The respective discharge portions D receive supply of the inks from the ink cartridges 31 corresponding to the head units HU on which the discharge portions D are provided. The respective discharge portions D can thereby be filled with the supplied inks and discharge the filled inks through nozzles N. That is to say, the 4M discharge portions D in total included in the head module HM can discharge the inks of the four colors of CMYK as a whole.

The storage unit 5 includes a volatile memory such as a RAM (random access memory) and a non-volatile memory such as a ROM (read only memory), an EEPROM (electrically erasable programmable read-only memory), a PROM (programmable ROM), or the like and stores therein various pieces of information such as the print data Img supplied from the host computer and a control program of the ink jet printer 1.

The controller 6 includes a CPU (central processing unit). It should be noted that the controller 6 may include a programmable logic device such as an FPGA (field-programmable gate array) instead of the CPU.

The CPU provided in the controller 6 executes the control program stored in the storage unit 5 to operate in accordance with the control program, so that the controller 6 controls the respective parts of the ink jet printer 1.

To be specific, the controller 6 generates a print signal SI for controlling the head module HM, a waveform specification signal dCom for controlling the drive signal generation circuit 2, a signal for controlling the transportation mechanism 7, and a print determination signal PT indicating whether the current time is in a period during printing.

The waveform specification signal dCom is a digital signal defining a waveform of the drive signal Com. The drive signal Com is an analog signal for driving the discharge portions D. The drive signal generation circuit 2 includes a DA (digital-to-analog) conversion circuit and generates the drive signal Com having the waveform defined by the waveform specification signal dCom. In the embodiment, it is presumed that the drive signal Com contains a drive signal Com-A and a drive signal Com-B.

The print signal SI is a digital signal for specifying a type of operations of the discharge portions D. To be specific, the print signal SI specifies the type of the operations of the discharge portions D by specifying whether the drive signal Com is supplied to the discharge portions D. The specification of the type of the operations of the discharge portions D indicates, for example, specification of whether the discharge portions D are driven, specification of whether the inks are discharged from the discharge portions D when the discharge portions D are driven, and specification of the ink amounts that are discharged from the discharge portions D when the discharge portions D are driven.

When the print processing is executed, the controller 6 first controls to store the print data Img supplied from the host computer in the storage unit 5. Then, the controller 6 generates various control signals such as the print signal SI, the waveform specification signal dCom, and the signal for controlling the transportation mechanism 7 based on the various pieces of data such as the print data Img stored in the storage unit 5. The controller 6 controls the transportation mechanism 7 so as to change the position of the recording paper PP relative to the head module HM and controls the head module HM so as to drive the discharge portions D based on the various control signals and the various pieces of data stored in the storage unit 5. Thus, the controller 6 controls execution of the print processing of forming the image corresponding to the print data Img on the recording paper PP while adjusting whether to discharge the inks from the discharge portions D, the discharge amounts of the inks, discharge timings of the inks, and the like.

One or a plurality of number of times of the print processing that are executed for forming one image indicated by the print data Img are referred to as a print task. One or a plurality of number of times of the print tasks that are executed for forming the image indicated by the print data Img by the number of print copies corresponding to the copy number information CP is referred to as a print job.

In the embodiment, the controller 6 determines, for example, a period from the start to the end of the print job to be the period during printing, sets the print determination signal PT to be at a low level in the period during printing, and sets the print determination signal PT to be at a high level in periods other than the period during printing. The periods other than the period during printing are, for example, a period during standby for waiting for a print execution instruction from a user, and the like.

The print determination signal PT is generated based on the print data Img and the copy number information CP, for example. A method for generating the print determination signal PT is not particularly limited and it is sufficient that the print determination signal PT is generated using the print data Img, the copy number information CP, the print signal SI, the waveform specification signal dCom, and a latch signal LAT (for the latch signal LAT, see FIG. 6) as appropriate.

2. Outlines of Recording Heads and Discharge Portions

The recording heads HD and the discharge portions D provided on the recording heads HD will be described with reference to FIG. 3A to FIG. 5.

Figure 3A:
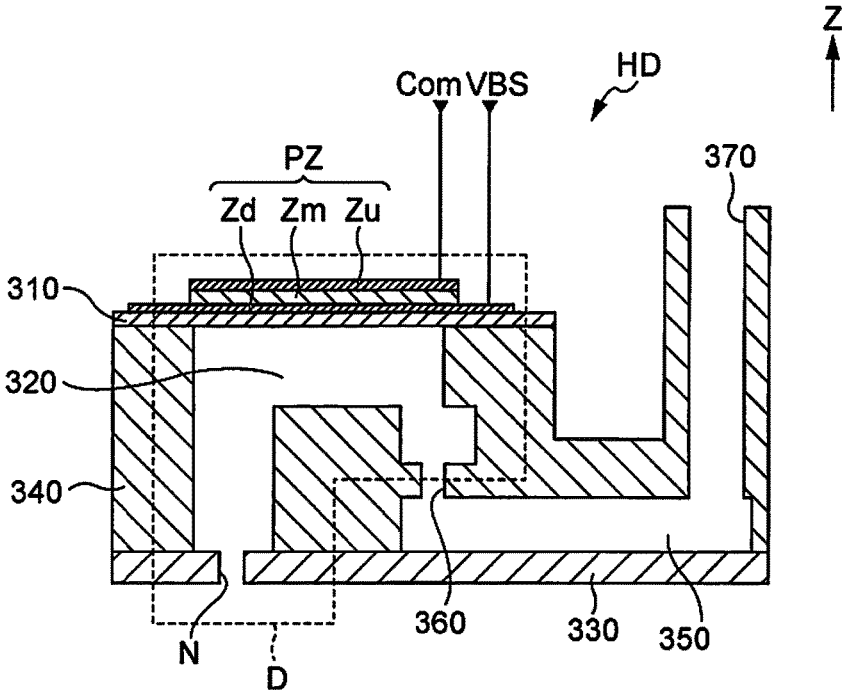
FIG. 3A is a descriptive view for explaining an example of the configuration of a discharge portion.

FIG. 3A is a schematic partial cross-sectional view illustrating the recording head HD when the recording head HD is cut so as to include the discharge portion D.

As illustrated in FIG. 3A, each discharge portion D includes the piezoelectric element PZ, a cavity 320 (an example of a "pressure chamber") filled with the ink, the nozzle N communicating with the cavity 320, and a vibration plate 310.

The cavity 320 is a space partitioned by a cavity plate 340, a nozzle plate 330 in which the nozzle N is formed, and the vibration plate 310. The cavity 320 communicates with a reservoir 350 with an ink supply port 360 interposed therebetween. The reservoir 350 communicates with the ink cartridge 31 corresponding to the discharge portion D with an ink inlet port 370 interposed therebetween.

The piezoelectric element PZ has an upper electrode Zu, a lower electrode Zd, and a piezoelectric body Zm provided between the upper electrode Zu and the lower electrode Zd. When a voltage is applied to between the upper electrode Zu and the lower electrode Zd by electrically connecting the lower electrode Zd to a feeding line LHd (see FIG. 6) set to have a potential VBS and supplying the drive signal Com to the upper electrode Zu, the piezoelectric element PZ is displaced in the +Z direction or −Z direction in accordance with the applied voltage, and the piezoelectric element PZ vibrates as a result. In the embodiment, as illustrated in FIG. 3A, a unimorph (monomorph)-type piezoelectric element PZ having the structure in which the piezoelectric body Zm is provided between a pair of the upper electrode Zu and the lower electrode Zd is employed.

The vibration plate 310 is installed in an upper surface opening of the cavity plate 340. The lower electrode Zd is joined to the vibration plate 310. Therefore, when the piezoelectric element PZ vibrates by being driven by the drive signal Com, the vibration plate 310 also vibrates. Then, the volume of the cavity 320 is changed with the vibration of the vibration plate 310 and the ink filling the cavity 320 is discharged through the nozzle N. When the ink in the cavity 320 is reduced by the discharge of the ink, the ink is supplied from the reservoir 350.

Figure 3B:
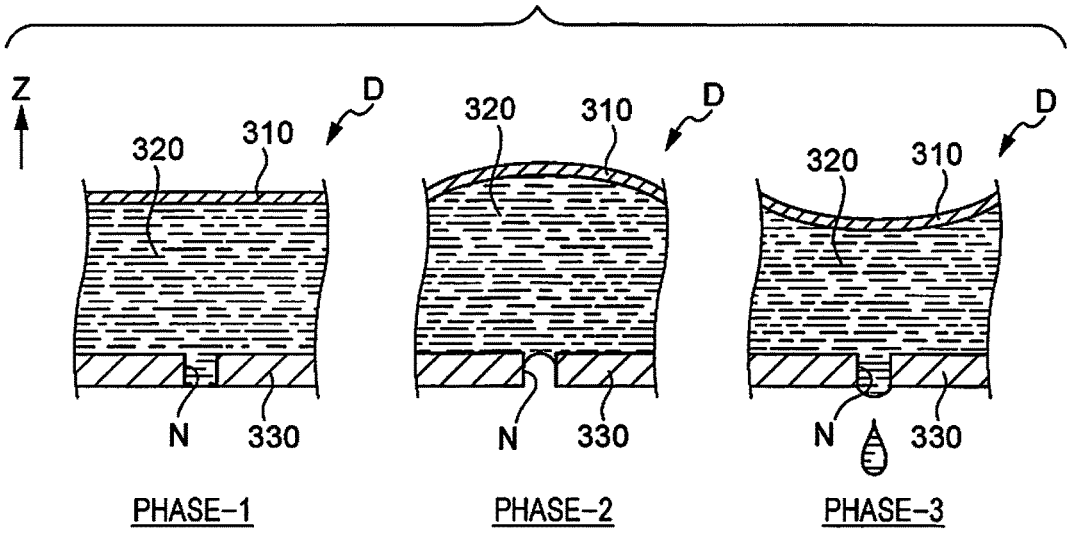
FIG. 3B is a descriptive view for explaining an example of an ink discharge operation in the discharge portion.

FIG. 3B is a descriptive view for explaining an example of an ink discharge operation in the discharge portion D. As illustrated in FIG. 3B as an example, the controller 6 changes a potential of the drive signal Com to be supplied to the piezoelectric element PZ included in the discharge portion D in a state of Phase 1 to generate such distortion that the piezoelectric element PZ is displaced in the +Z direction and cause the vibration plate 310 of the discharge portion D to be deflected in the +Z direction. With this operation, as in a state of Phase-2 illustrated in FIG. 3B, the volume of the cavity 320 of the discharge portion D is increased in comparison with that in the state of Phase-1. Then, the controller 6 changes the potential indicated by the drive signal Com to generate such distortion that the piezoelectric element PZ is displaced in the −Z direction and cause the vibration plate 310 of the discharge portion D to be deflected in the −Z direction. With this operation, as in a state of Phase-3 illustrated in FIG. 3B, the volume of the cavity 320 is drastically decreased and a part of the ink filling the cavity 320 is discharged as an ink droplet through the nozzle N communicating with the cavity 320.

The piezoelectric body Zm that is used for the piezoelectric element PZ included in the discharge portion D is preferably a thin film having the thickness, for example, equal to or less than 5 μm (to be more specific, for example, equal to or more than 1.0 μm and equal to or less than 1.5 μm). As a reason for this, reduction of the piezoelectric body Zm in thickness can increase the displacement amount of the piezoelectric element PZ for a predetermined application voltage. The piezoelectric element PZ using the thin-film piezoelectric body Zm is manufactured by the MEMS technique in many cases in terms of enhancement of mass productivity and reduction in size. The MEMS technique enables manufacturing of the recording head HD including a large number of (equal to or more than 600 units of) discharge portions D with a high nozzle density (equal to or higher than 300 dpi).

FIG. 4A to FIG. 4E are partial cross-sectional views of the piezoelectric body Zm. Hereinafter, each piezoelectric body Zm is described with reference to FIG. 4A to FIG. 4E. In FIG. 4A to FIG. 4E, it is presumed that a +W direction and the +Z direction are identical to each other when the discharge portion D on which the piezoelectric body Zm is mounted is provided on the recording head HD. In the following description, the +W direction and a −W direction as an opposite direction thereto are collectively referred to as a W-axis direction in some cases.

Figure 4A:
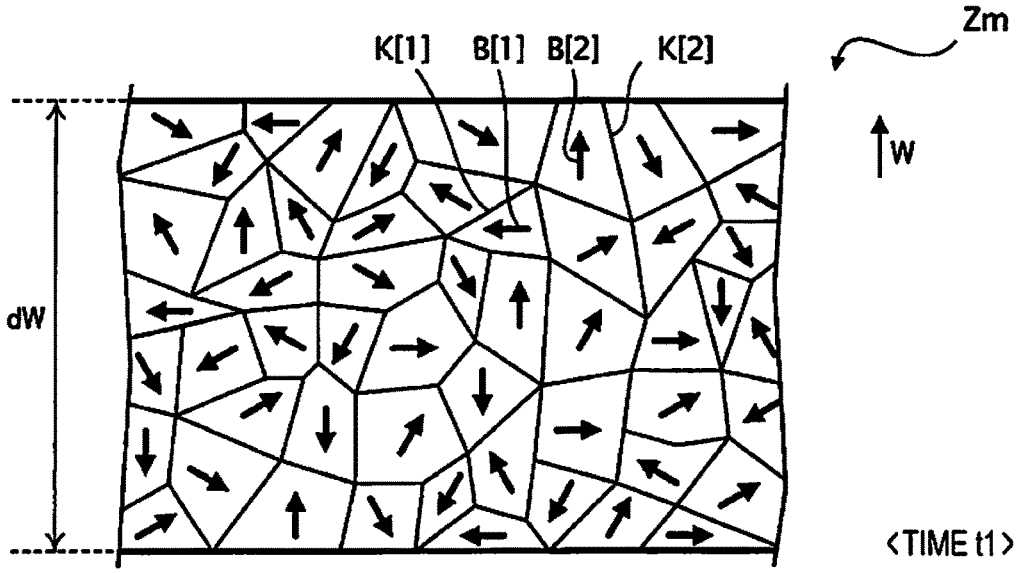
FIG. 4A is a descriptive view for explaining a piezoelectric body.

It is difficult to form the piezoelectric body Zm as a single crystal body and is therefore formed as a polycrystal body as an aggregate of ferroelectric microcrystals. For example, as illustrated in FIG. 4A, the piezoelectric body Zm is formed as the aggregate of ferroelectric microcrystals K at time t1 in manufacturing of the piezoelectric body Zm.

In manufacturing, the directions of spontaneous polarization of the individual microcrystals are spontaneously non-uniform, and piezoelectric characteristics of the piezoelectric body Zm do not therefore appear. For example, as illustrated in FIG. 4A, among the plurality of microcrystals K contained in the piezoelectric body Zm, a polarization direction B[1] of a microcrystal K[1] and a polarization direction B[2] of a microcrystal K[2] are different from each other at the time t1.

For coping with this, poling of making the polarization directions uniform by application of a predetermined DC electric field to the piezoelectric body Z is performed before the piezoelectric body Zm is incorporated in the ink jet printer 1. The poling causes the piezoelectric characteristics of the piezoelectric body Zm to appear.

Hereinafter, as the electric field that is applied to the piezoelectric body Zm, an electric field having polarity the same as that in the poling is referred to as a same-polarity electric field whereas an electric field having polarity reverse to that in the poling is referred to as a reverse-polarity electric field in some cases. In the embodiment, when the potential of the upper electrode Zu of the piezoelectric element PZ is higher than the potential of the lower electrode Zd thereof, the same-polarity electric field is applied to the piezoelectric body Zm, as an example. That is, when the potential of the upper electrode Zu of the piezoelectric element PZ is lower than the potential of the lower electrode Zd thereof, the reverse-polarity electric field is applied to the piezoelectric body Zm, as an example.

Figure 4B:
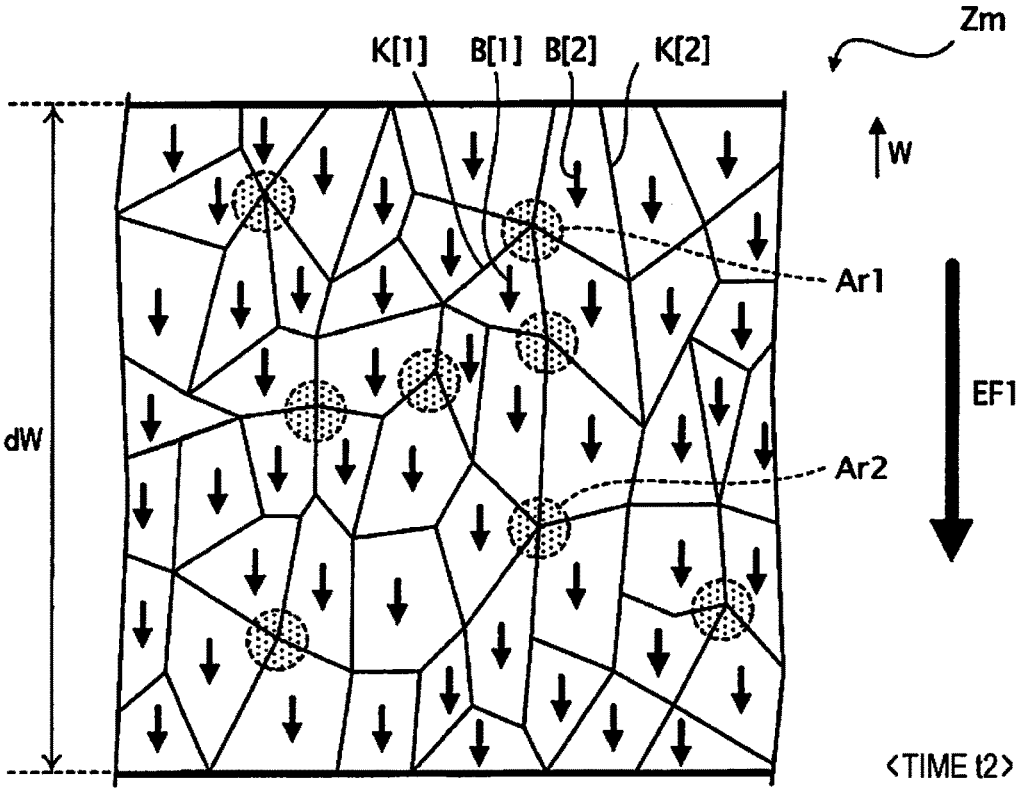
FIG. 4B is a descriptive view for explaining the piezoelectric body.

For example, as illustrated in FIG. 4B, when the piezoelectric body Zm is subject to the poling by application of a same-polarity electric field EF1 thereto at time t2, which is after the time t1, in the manufacturing of the piezoelectric body Zm, the polarization directions B of the respective microcrystals K contained in the piezoelectric body Zm are the same directions as the same-polarity electric field EF1, that is, the −W direction. To be specific, the polarization direction B[1] of the microcrystal K[1] and the polarization direction B[2] of the microcrystal K[2] are uniformly the −W direction at the time t2.

When the piezoelectric body Zm is subject to the poling, a thickness dW of the piezoelectric body Zm in the W-axis direction is changed in some cases. For example, as illustrated in FIG. 4A and FIG. 4B, the thickness dW of the piezoelectric body Zm at the time t2 after the piezoelectric body Zm is subject to the poling can be increased in comparison with the thickness dW of the piezoelectric body Zm at the time t1 before the piezoelectric body Zm is subject to the poling. In other words, in some cases the piezoelectric body Zm is stretched in the W-axis direction by being subject to the poling. Therefore, after the piezoelectric body Zm is subject to the poling, stress present between the plurality of microcrystals K contained in the piezoelectric body Zm becomes non-uniform in the piezoelectric body Zm. Accordingly, in the piezoelectric body Zm, after the piezoelectric body Zm is subject to the poling, stress concentration areas Ar in which the stress is concentrated are present between the plurality of microcrystals K contained in the piezoelectric body Zm.

Figure 4C:
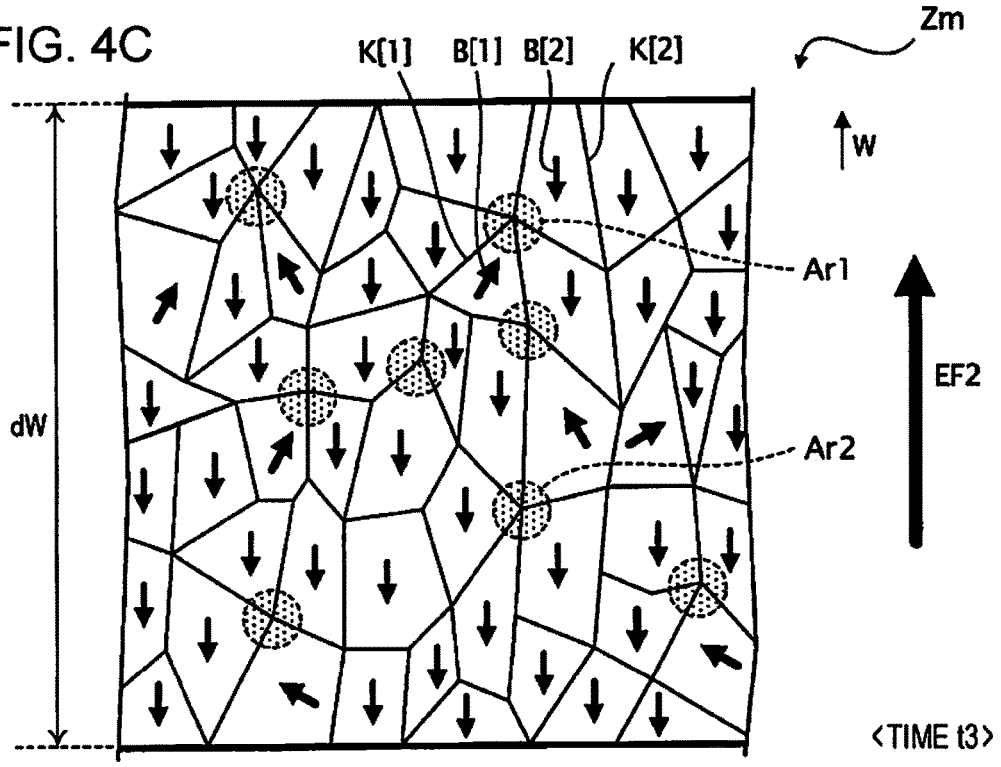
FIG. 4C is a descriptive view for explaining the piezoelectric body.

In driving of the piezoelectric element PZ, when the reverse-polarity electric field is applied to the piezoelectric body Zm, the polarization directions that have been made uniform by the poling are disturbed. For example, as illustrated in FIG. 4C, when a reverse-polarity electric field EF2 directing to the +W direction is applied to the piezoelectric body Zm at time t3, which is after the time t2, the polarization directions B of at least some microcrystals K of the plurality of microcrystals K contained in the piezoelectric body Zm are changed to directions differing from the −W direction as the polarization directions B at the time t1. For example, FIG. 4C illustrates the case in which the polarization direction B[1] of the microcrystal K[1] is changed to the direction differing from the −W direction. It is considered that even when the reverse-polarity electric field EF2 is applied to the piezoelectric body Zm, there are the microcrystals K the polarization directions B of which are not changed from the −W direction as the polarization directions B at the time t1 among the plurality of microcrystals K contained in the piezoelectric body Zm. For example, FIG. 4C illustrates the case in which the polarization direction B[2] of the microcrystal K[2] keeps the same direction as the −W direction. That is to say, in the case illustrated in FIG. 4C, the polarization direction B[1] of the microcrystal K[1] and the polarization direction B[2] of the microcrystal K[2] are different directions. The above-described disturbance of the polarization directions B can increase the degree of concentration of the stress in the stress concentration areas Ar, for example. Furthermore, the above-described disturbance of the polarization directions B lowers the piezoelectric characteristics. Therefore, there is the risk of causing operation failure of the piezoelectric element PZ.

Figure 4D:
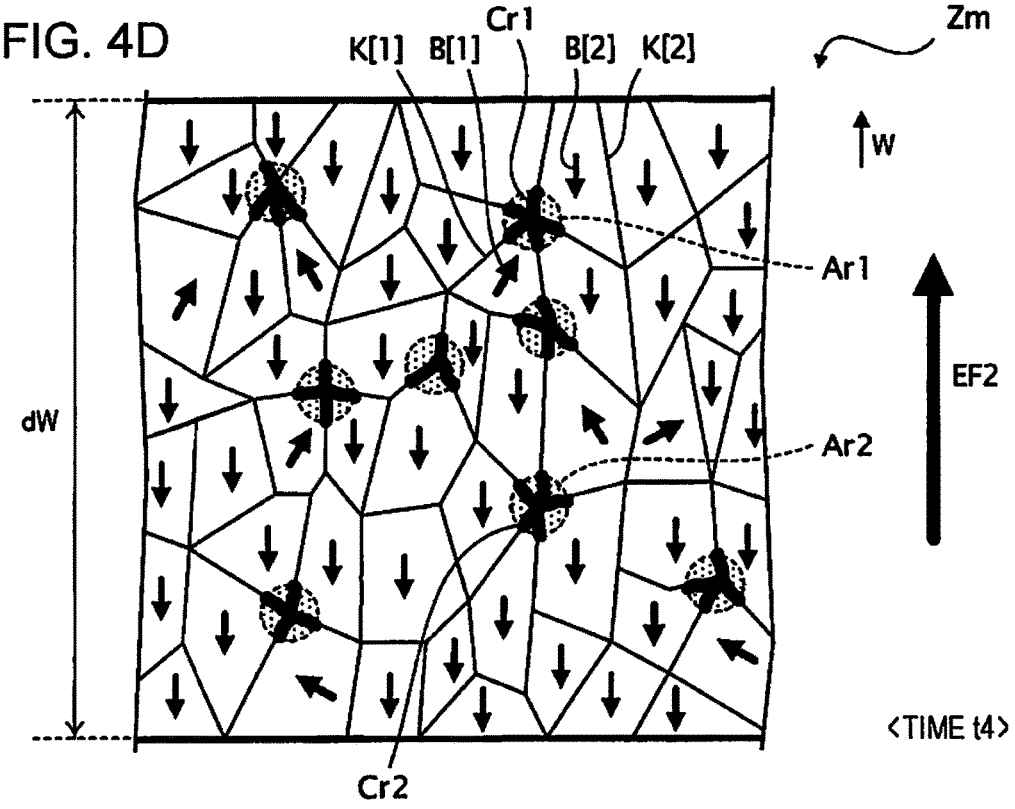
FIG. 4D is a descriptive view for explaining the piezoelectric body.

It should be noted that the piezoelectric body Zm is the polycrystal body. Therefore, when partial stress concentration or the like occurs in the piezoelectric body Zm in a manufacturing process or a poling process, latent fine cracks are generated in the piezoelectric body Zm. For example, as illustrated in FIG. 4D, fine cracks Cr are generated in the stress concentration areas Ar and the like at time t4, which is after the time t3. FIG. 4D illustrates the case in which a fine crack Cr1 is generated in a stress concentration area Ar1 and a fine crack Cr2 is generated in a stress concentration area Ar2.

Figure 4E:
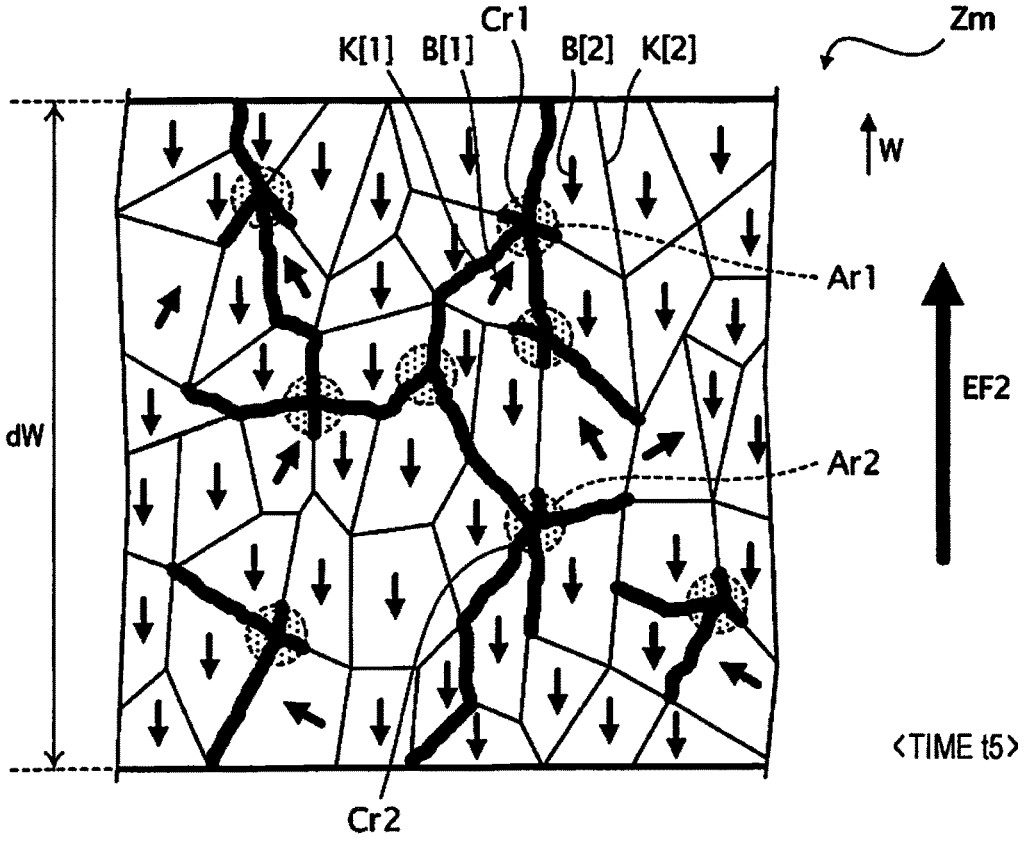
FIG. 4E is a descriptive view for explaining the piezoelectric body.

The application of the reverse-polarity electric field not only disturbs the polarization directions in the piezoelectric body Zm but also grows the fine cracks due to the difference in a change manner of the polarization direction among the microcrystals. For example, FIG. 4E illustrates the case in which the fine crack Cr1 generated in the stress concentration area Ar1 and the fine crack Cr2 generated in the stress concentration area Ar2 grow at time t5, which is after the time t4, and the fine crack Cr1 and the fine crack Cr2 are joined together as a result.

The fine cracks Cr generated in the piezoelectric body Zm grow due to vibration of the piezoelectric body Zm by the drive signal Com in some cases. The growth of the fine cracks Cr can cause breakage of the piezoelectric body Zm. Particularly in the thin-film piezoelectric body Zm, the grown cracks easily penetrate through the piezoelectric body Zm in the thickness direction. For example, FIG. 4E illustrates the case in which the fine crack Cr that has grown while involving the joint of the fine crack Cr1 and the fine crack Cr2 penetrates through the piezoelectric body Zm in the W-axis direction at time t5. When the fine crack Cr penetrates through the piezoelectric body Zm in the thickness direction, an electric short-circuit occurs between the upper electrode Zu and the lower electrode Zd and the function of the piezoelectric element PZ is impaired.

In the above-described manner, application of the reverse-polarity electric field disturbs the polarization directions of the piezoelectric body Zm to lower the piezoelectric characteristics or breaks the piezoelectric body Zm in some cases. Therefore, it is preferable that application of the reverse-polarity electric field to the piezoelectric element PZ, in particular, application thereof for a long period of time or application of a high electric field be suppressed.

The waveforms of the drive signals Com-A and Com-B to be supplied to the upper electrode Zu are therefore set such that the same-polarity electric field is applied to the piezoelectric element PZ. Application of the reverse-polarity electric field to the piezoelectric element PZ for a short period of time and application of a low reverse-polarity electric field are allowed.

The waveforms of the drive signals Com-A and Com-B may be set such that the reverse-polarity electric field is applied in a part of a unit print period Tu. To be specific, the reverse-polarity electric field may be applied in a period corresponding to the vicinity of a minimum potential VLX of a waveform PX of the drive signal Com-A (for the unit print period Tu, the waveform PX, and the minimum potential VLX, see FIG. 8).

The degree (time length or intensity) of the reverse-polarity electric field that is allowed to be applied can be confirmed by, for example, an experiment, and appropriate waveforms of the drive signals Com-A and Com-B can be set based on the experiment.

The potential of the lower electrode Zd of the piezoelectric element PZ is set to be the potential VBS (an example of a "first potential") as described above (the potential VBS is applied to the lower electrode Zd). In the embodiment, the potential VBS is set to a predetermined potential that is higher than a ground potential. Application of the potential VBS to the lower electrode Zd is effective as a technique for suppressing leak current between the upper electrode Zu and the lower electrode Zd and is particularly effective in the piezoelectric element PZ using the thin-film piezoelectric body Zm that easily generates leak current. The application of the potential VBS to the lower electrode Zd is also effective as a technique for operating the piezoelectric element PZ in an optimum displacement region as a region in which an electrodynamic conversion relation is closely linear in electrodynamic conversion characteristics of the piezoelectric element PZ.

On the other hand, the application of the potential VBS to the lower electrode Zd easily causes a state in which the potential of the upper electrode Zu is lower than the potential of the lower electrode Zd, that is, a state in which the reverse-polarity electric field is applied to the piezoelectric element PZ.

Although the potential VBS is ideally constant, actually, the potential VBS varies (fluctuates) by being influenced by various signals supplied to wirings included in the ink jet printer 1, external disturbance due to electromagnetic waves, and the like in some cases. The fluctuation of the potential VBS can make the potential of the upper electrode Zu be lower than the potential of the lower electrode Zd.

Figure 5:
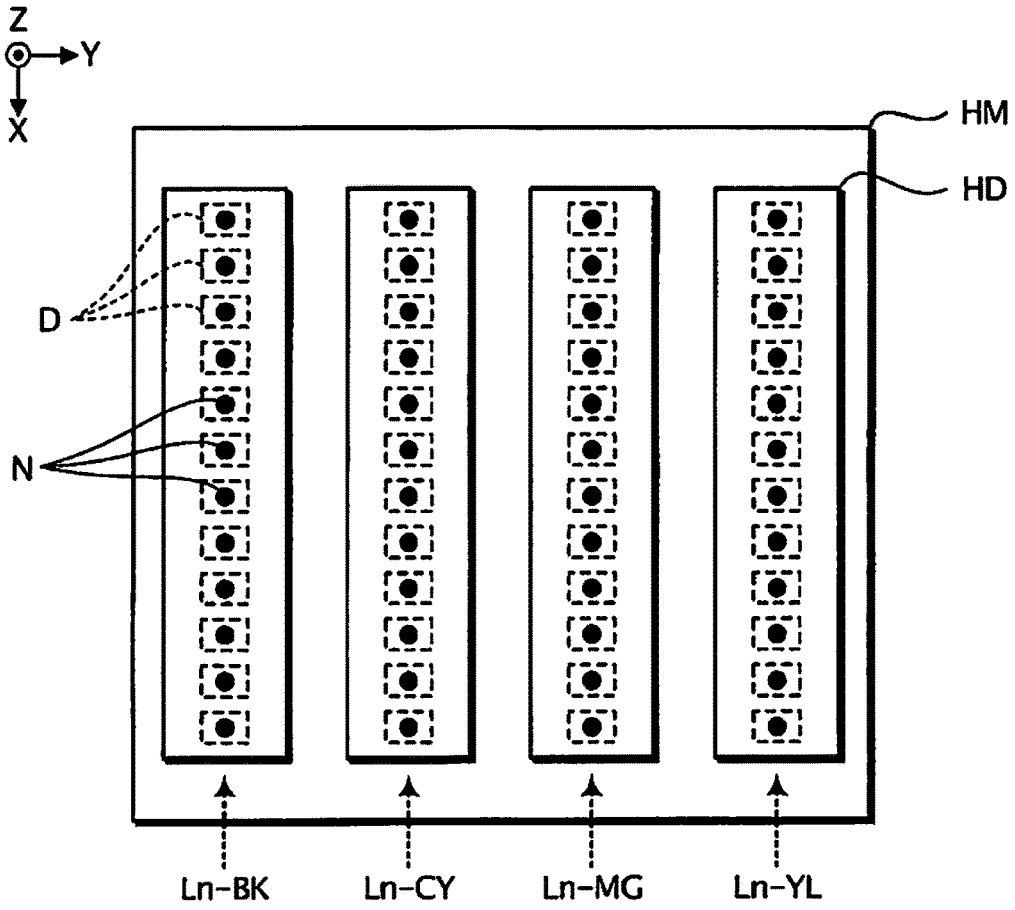
FIG. 5 is a plan view illustrating an example of arrangement of nozzles in a head module.

FIG. 5 is a descriptive view for explaining an example of arrangement of the four recording heads HD included in the head module HM and the 4M nozzles N in total provided on the four recording heads when the ink jet printer 1 is seen from above from the +Z direction or the −Z direction.

As illustrated in FIG. 5, nozzle rows Ln are provided in the respective recording heads HD provided in the head module HM. The nozzle rows Ln are the plurality of nozzles N provided so as to extend in rows in a predetermined direction. In the embodiment, each nozzle row Ln is formed by arranging the M nozzles N so as to extend in a row in the X-axis direction.

Hereinafter, as illustrated in FIG. 5, the four nozzle rows Ln provided in the head module HM are referred to as nozzle rows Ln-BK, Ln-CY, Ln-MG, and Ln-YL. The nozzle row Ln-BK is the nozzle row Ln in which the nozzles N of the discharge portions D for discharging the black ink are aligned, the nozzle row Ln-CY is the nozzle row Ln in which the nozzles N of the discharge portions D for discharging the cyan ink are aligned, the nozzle row Ln-MG is the nozzle row Ln in which the nozzles N of the discharge portions D for discharging the magenta ink are aligned, and the nozzle row Ln-YL is the nozzle row Ln in which the nozzles N of the discharge portions D for discharging the yellow ink are aligned.

FIG. 5 is an example and the M nozzles N belonging to each nozzle row Ln may be arranged with a predetermined width in the direction intersecting with the extension direction of the nozzle row Ln. That is to say, the M nozzles N belonging to each nozzle row Ln may be arranged in a zigzag form, for example, such that positions of the even-numbered nozzles N from the +X side and positions of the odd-numbered nozzles N from the +X side are different from each other in the Y-axis direction. Furthermore, each nozzle row Ln may extend in a direction differing from the X-axis direction. In the embodiment, the number of nozzle rows Ln provided in each recording head HD is "1", as an example. Alternatively, two nozzle rows Ln or more may be provided in each recording head HD.

3. Configuration of Head Unit

Hereinafter, the configuration of each head unit HU will be described with reference to FIG. 6 and FIG. 7.

Figure 6:
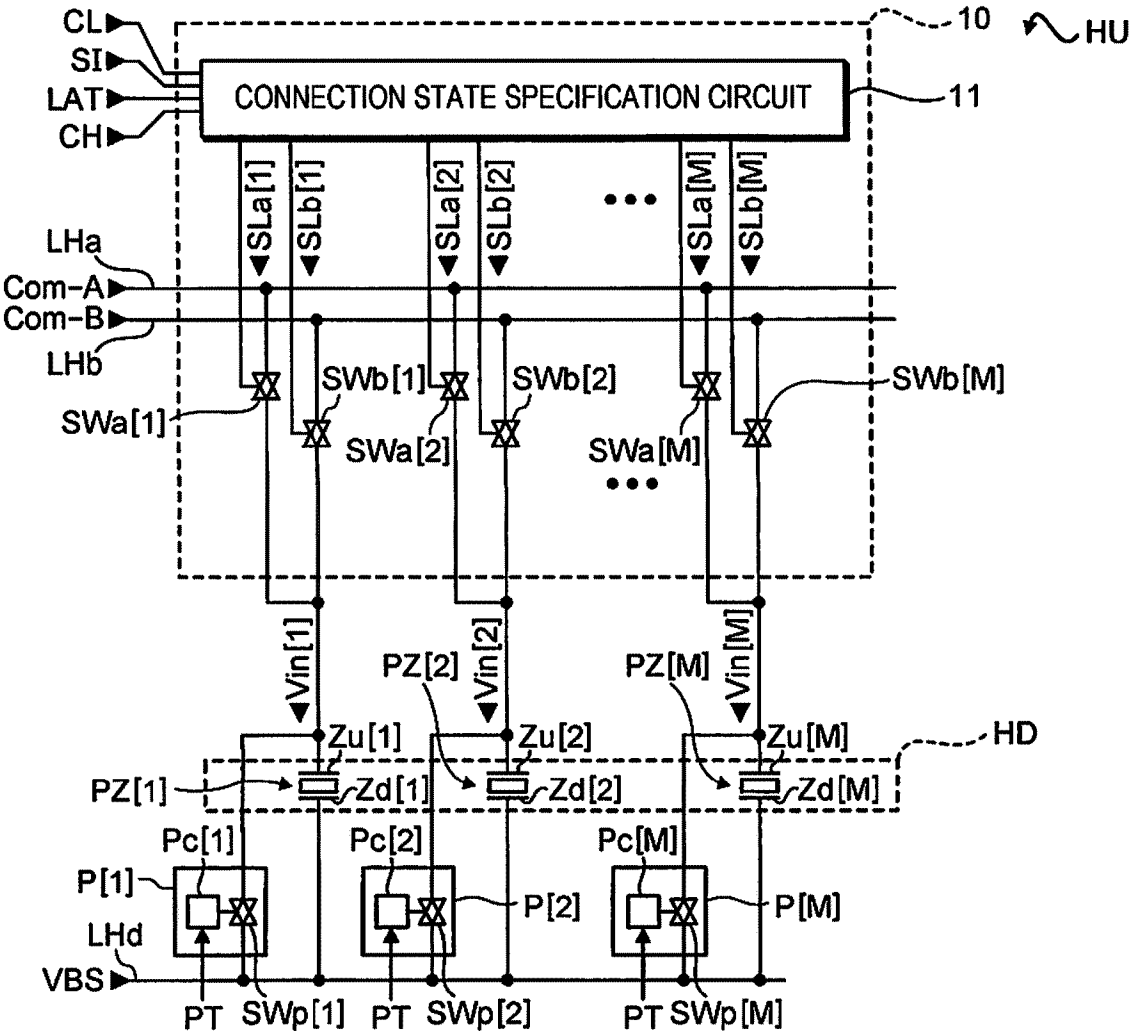
FIG. 6 is a block diagram illustrating an example of the configuration of a head unit.

FIG. 6 is a block diagram illustrating an example of the configuration of the head unit HU. As described above, the head unit HU includes the recording head HD, the switching circuit 10, and the protection portions P provided for the respective discharge portions D of the recording head HD. The head unit HU includes an internal wiring LHa for supplying the drive signal Com-A from the drive signal generation circuit 2, and an internal wiring LHb for supplying the drive signal Com-B from the drive signal generation circuit 2.

As illustrated in FIG. 6, the switching circuit 10 includes M switches SWa (SWa[1] to SWa[M]), M switches SWb (SWb[1] to SWb[M]), and a connection state specification circuit 11 for specifying connection states of the respective switches. As the respective switches, for example, transmission gates can be employed.

The connection state specification circuit 11 generates connection state specification signals SLa[1] to SLa[M] specifying ON/OFF of the switches SWa[1] to SWa[M] and connection state specification signals SLb[1] to SLb[M] specifying ON/OFF of the switches SWb[1] to SWb[M] based on at least some signals of the print signal SI, the latch signal LAT, and a change signal CH that are supplied from the controller 6.

The switch SWa[m] switches conduction and non-conduction between the internal wiring LHa and the upper electrode Zu[m] of the piezoelectric element PZ[m] provided in the discharge portion D[m] in accordance with the connection state specification signal SLa[m]. In the embodiment, the switch SWa[m] is made into an ON state when the connection state specification signal SLa[m] is at a high level and is made into an OFF state when the connection state specification signal SLa[m] is at a low level.

The switch SWb(m) switches conduction and non-conduction between the internal wiring LHb and the upper electrode Zu[m] of the piezoelectric element PZ[m] provided in the discharge portion DM in accordance with the connection state specification signal SLb[m]. In the embodiment, the switch SLb[m] is set to an ON state when the connection state specification signal SLb[m] is at a high level and is set to an OFF state when the connection state specification signal SLb[m] is at a low level.

A signal of the drive signals Com-A and Com-B, which is supplied to the piezoelectric element PZ[m] of the discharge portion D[m] after passing through the switch SWa[m] or SLb[m], is referred to as a supply drive signal Vin[m] in some cases.

The protection portion P[m] provided for the discharge portion D[m] includes a switch SWp[m] and a protection control circuit Pc[m] controlling ON/OFF of the switch SWp[m]. The print determination signal PT is supplied to the protection control circuit Pc[m].

The switch SWp[m] is controlled by the protection control circuit Pc[m] to switch conduction and non-conduction between the upper electrode Zu[m] and the lower electrode Zd[m] included in the piezoelectric element PZ[m] provided in the discharge portion D[m]. The protection control circuit Pc[m] controls ON/OFF of the switch SWp[m] in accordance with a comparison result between the potential of the upper electrode Zu[m] of the piezoelectric element PZ[m] and the potential of the lower electrode Zd[m] thereof.

In the embodiment, the protection control circuit Pc[m] keeps the switch SWp[m] in an OFF state when the print determination signal PT is at the low level (that is, in the period during printing). In the embodiment, the protection control circuit Pc[m] switches ON/OFF of the switch SWp [m] when the print determination signal PT is at the high level (that is, in the periods other than the period during printing).

Figure 7:
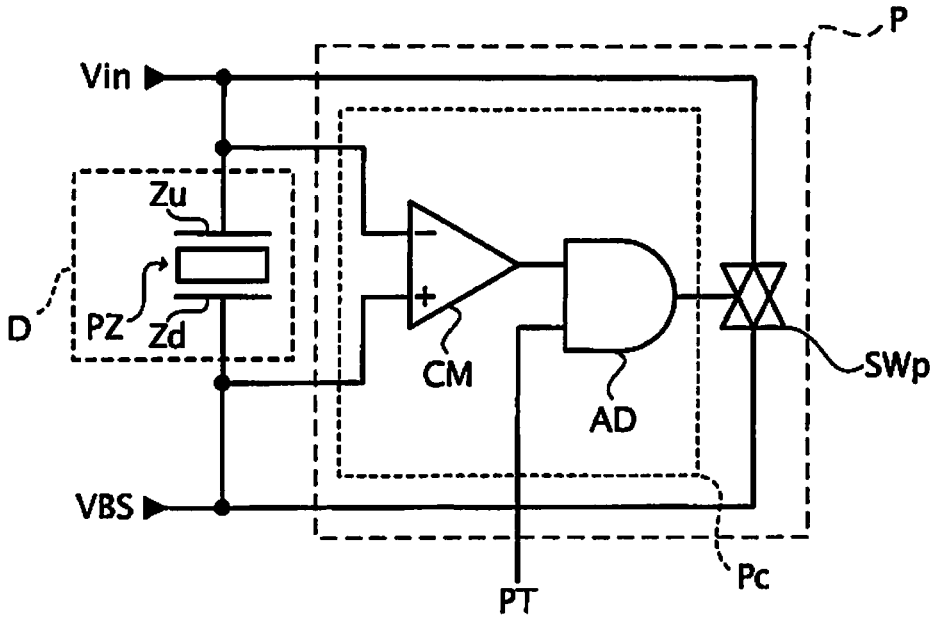
FIG. 7 is a diagram illustrating an example of the configurations of a switch and a protection control circuit of a protection portion.

FIG. 7 is a diagram illustrating an example of the configurations of the switch SWp and the protection control circuit Pc of the protection portion P. As the switch SWp, for example, a transmission gate can be employed. The protection control circuit Pc includes a comparator CM (an example of a comparison unit) and an AND circuit AD.

One input terminal of the comparator CM and the other input terminal thereof are electrically connected to the upper electrode Zu and the lower electrode Zd of the piezoelectric element PZ included in the discharge portion D corresponding to the protection portion P, respectively. An output signal of the comparator CM is at a low level when the potential of the upper electrode Zu is higher than the potential of the lower electrode Zd whereas the output signal is at a high level when the potential of the upper electrode Zu is lower than the potential of the lower electrode Zd.

The output signal of the comparator CM and the print determination signal PT are respectively input to one input terminal and the other input terminal of the AND circuit AD. In the case in which the print determination signal PT is at the low level, an output signal of the AND circuit AD is at a low level regardless of whether the output signal of the comparator CM is at the low level or the high level. In the case in which the print determination signal PT is at the high level, the output signal of the AND circuit AD is at the low level when the output signal of the comparator CM is at the low level and the output signal of the AND circuit AD is at a high level when the output signal of the comparator CM is at the high level.

The output signal of the AND circuit AD is supplied to the switch SWp as a control signal for controlling ON/OFF of the switch SWp. The switch SWp is set to the OFF state when the output signal of the AND circuit AD is at the low level whereas the switch SWp is set to the ON state when the output signal of the AND circuit AD is at the high level.

With this configuration, the protection control circuit Pc sets the switch SWp to the OFF state when the print determination signal PT is at the low level and when the print determination signal PT is at the high level and the output signal of the comparator CM is at the low level. The protection control circuit Pc set the switch SWp to the ON state when the print determination signal PT is at the high level and the output signal of the comparator CM is at the high level.

4. Operations of Head Unit

Hereinafter, operations of each head unit HU will be described with reference to FIG. 8 to FIG. 11.

In the embodiment, the period during printing in which the ink jet printer 1 executes the print job includes one or a plurality of unit print periods Tu. In each unit print period Tu, the respective discharge portions D are driven in the print processing.

The ink jet printer 1 according to the embodiment repeatedly executes the print processing over the plurality of continuous or intermittent unit print periods Tu to discharge the inks from the respective discharge portions D once or a plurality of number of times in each processing. Thus, the ink jet printer 1 executes the print task of forming the image indicated by the print data Img.

Figure 8:
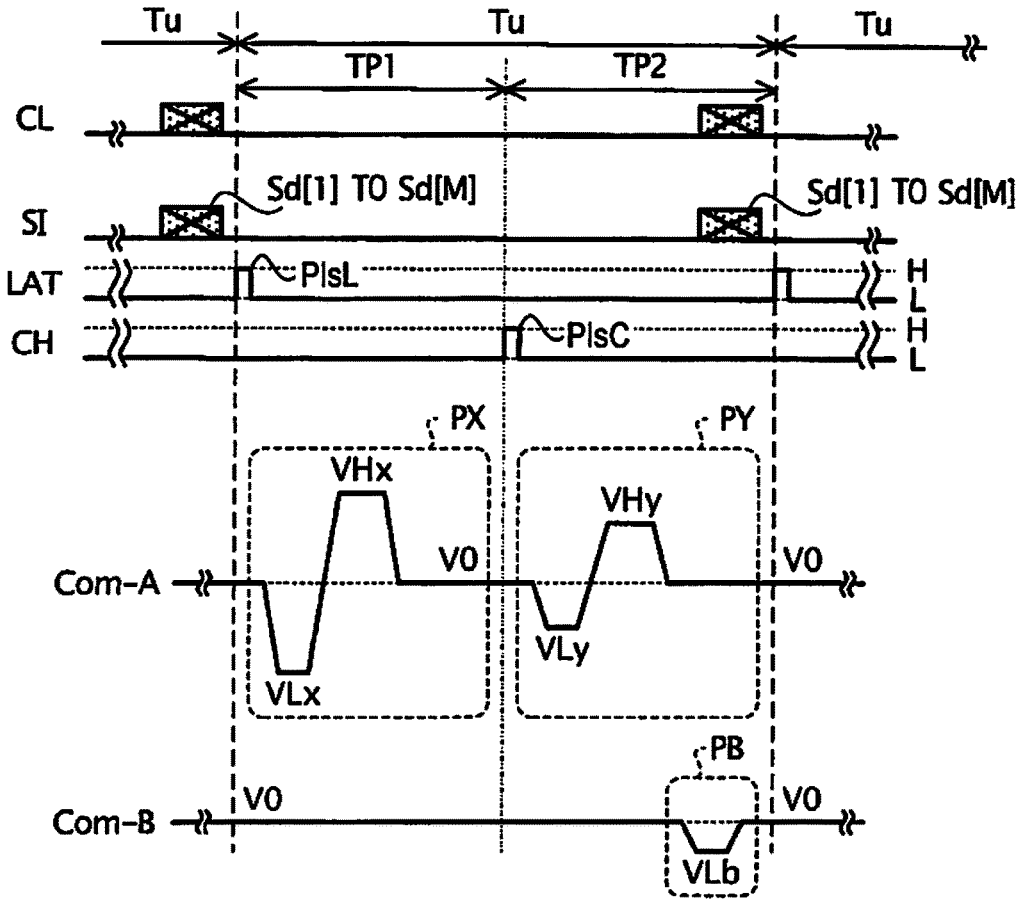
FIG. 8 is a timing chart for explaining an example of print processing.

FIG. 8 is a timing chart illustrating an example of the operations of the ink jet printer 1 in the unit print periods Tu.

As illustrated in FIG. 8, the controller 6 outputs the latch signal LAT having pulses PlsL. The controller 6 thereby defines the unit print period Tu as a period from a rising edge of the pulse PlsL to a rising edge of the subsequent pulse PlsL.

The controller 6 outputs the change signal CH having a pulse PlsC in the unit print period Tu. Then, the controller 6 divides each unit print period Tu into a control period TP1 from the rising edge of the pulse PlsL to a rising edge of the pulse PlsC and a control period TP2 from the rising edge of the pulse PlsC to the rising edge of the pulse PlsL.

The print signal SI that the controller 6 outputs includes individual specification signals Sd[1] to Sd[M] for specifying drive modes of the discharge portions D[1] to D[M] in the respective unit print periods Tu. Then, when the print processing is executed in the unit print period Tu, the controller 6 supplies the individual specification signals Sd[1] to Sd[M] to the connection state specification circuit 11 in synchronization with a clock signal CL before the unit print period Tu. In this case, the connection state specification circuit 11 generates the connection state specification signals SLa[m] and SLb[m] based on the individual specification signal Sd[m] in the unit print period Tu.

The individual specification signal Sd[m] according to the embodiment specifies, for the discharge portion DM, any one drive mode of four drive modes of discharge of the ink for an amount corresponding to a large-sized dot (large amount) (referred to as "formation of a large-sized dot" in some cases), discharge of the ink for an amount corresponding to a middle-sized dot (moderate amount) (referred to as "formation of a middle-sized dot" in some cases), discharge of the ink for an amount corresponding to a small-sized dot (small amount) (referred to as "formation of a small-sized dot" in some cases), and non-discharge of the ink in each unit print period Tu.

In the embodiment, it is presumed that the individual specification signal Sd[m] is a 2-bit digital signal (see FIG. 9).

As illustrated in FIG. 8, the drive signal Com-A has the waveform PX provided in the control period TP1 and a waveform PY provided in the control period TP2. In the embodiment, the waveform PX and the waveform PY are determined such that a potential difference between a maximum potential VHX and the minimum potential VLX of the waveform PX is larger than a potential difference between a maximum potential VHY and a minimum potential VLY of the waveform PY. To be specific, the waveform PX is determined such that the moderate amount of ink is discharged from the discharge portion D[m] when the discharge portion DM is driven with the drive signal Com-A having the waveform PX. The waveform PY is determined such that the small amount of ink is discharged from the discharge portion DM when the discharge portion D[m] is driven with the drive signal Com-A having the waveform PY. The waveform PX and the waveform PY are set such that potentials at the start time and the end time are a reference potential V0.

As illustrated in FIG. 8, the potential of the drive signal Com-B is kept to be the reference potential V0 in the control period TP1. The drive signal Com-B has a waveform PB provided in the control period TP2. In the embodiment, the waveform PB is determined such that a potential difference between a maximum potential (in the embodiment, the reference potential V0 as an example) and a minimum potential VLb of the waveform PB is smaller than a potential difference between the maximum potential VHY and the minimum potential VLY of the waveform PY. To be specific, the waveform PB is determined such that the discharge portion D[m] finely vibrates to an extent of causing no ink to be discharged from the discharge portion D[m] when the discharge portion D[m] is driven with the drive signal Com-B having the waveform PB. The waveform PB is set such that potentials at the start time and the end time are the reference potential V0.

FIG. 9 is a descriptive view for explaining a relation between the individual specification signal Sd[m] and the connection state specification signals SLa[m] and SLb[m] in the unit print period Tu. As illustrated in FIG. 9, in the embodiment, the individual specification signal Sd[m] is set to be any value of four values of a value (1, 1) specifying the formation of the large-sized dot, a value (1, 0) specifying the formation of the middle-sized dot, a value (0, 1) specifying the formation of the small-sized dot, and a value (0, 0) specifying non-discharge of the ink in the unit print period Tu.

A illustrated in FIG. 9, the connection state specification circuit 11 sets the connection state specification signal SLa[m] to be at the high level in the unit print period Tu (control periods TP1 and TP2) and sets the connection state specification signal SLb[m] to be at the low level in the unit print period Tu when the individual specification signal Sd[m] indicates the value (1, 1) specifying the formation of the large-sized dot. In this case, the discharge portion D[m] is driven with the drive signal Com-A having the waveform PX and discharges the moderate amount of ink in the control period TP1 and is driven with the drive signal Com-A having the waveform PY and discharges the small amount of ink in the control period TP2. The discharge portion D[m] thereby discharges the large amount of ink in total in the unit print period Tu and a large-sized dot is formed on the recording paper PP.

The connection state specification circuit 11 sets the connection state specification signal SLa[m] to be at the high level in the control period TP1 and to be at the low level in the control period TP2 and sets the connection state specification signal SLb[m] to be at the low level in the unit print period Tu when the individual specification signal Sd[m] indicates the value (1, 0) specifying the formation of the middle-sized dot. In this case, the discharge portion D[m] discharges the moderate amount of ink in the unit print period Tu and a middle-sized dot is formed on the recording paper PP.

The connection state specification circuit 11 sets the connection state specification signal SLa[m] to be at the low level in the control period TP1 and to be at the high level in the control period TP2 and sets the connection state specification signal SLb[m] to be at the low level in the unit print period Tu when the individual specification signal Sd[m] indicates the value (0, 1) specifying the formation of the small-sized dot. In this case, the discharge portion D[m] discharges the small amount of ink in the unit print period Tu and a small-sized dot is formed on the recording paper PP.

The connection state specification circuit 11 sets the connection state specification signal SLb[m] to be at the high level in the control periods TP1 and TP2 and sets the connection state specification signal SLa[m] to be at the low level in the unit print period Tu when the individual specification signal Sd[m] indicates the value (0, 0) specifying the non-discharge of the ink. In this case, the discharge portion D[m] discharges no ink in the unit print period Tu and no dot is formed on the recording paper PP.

Figure 10:
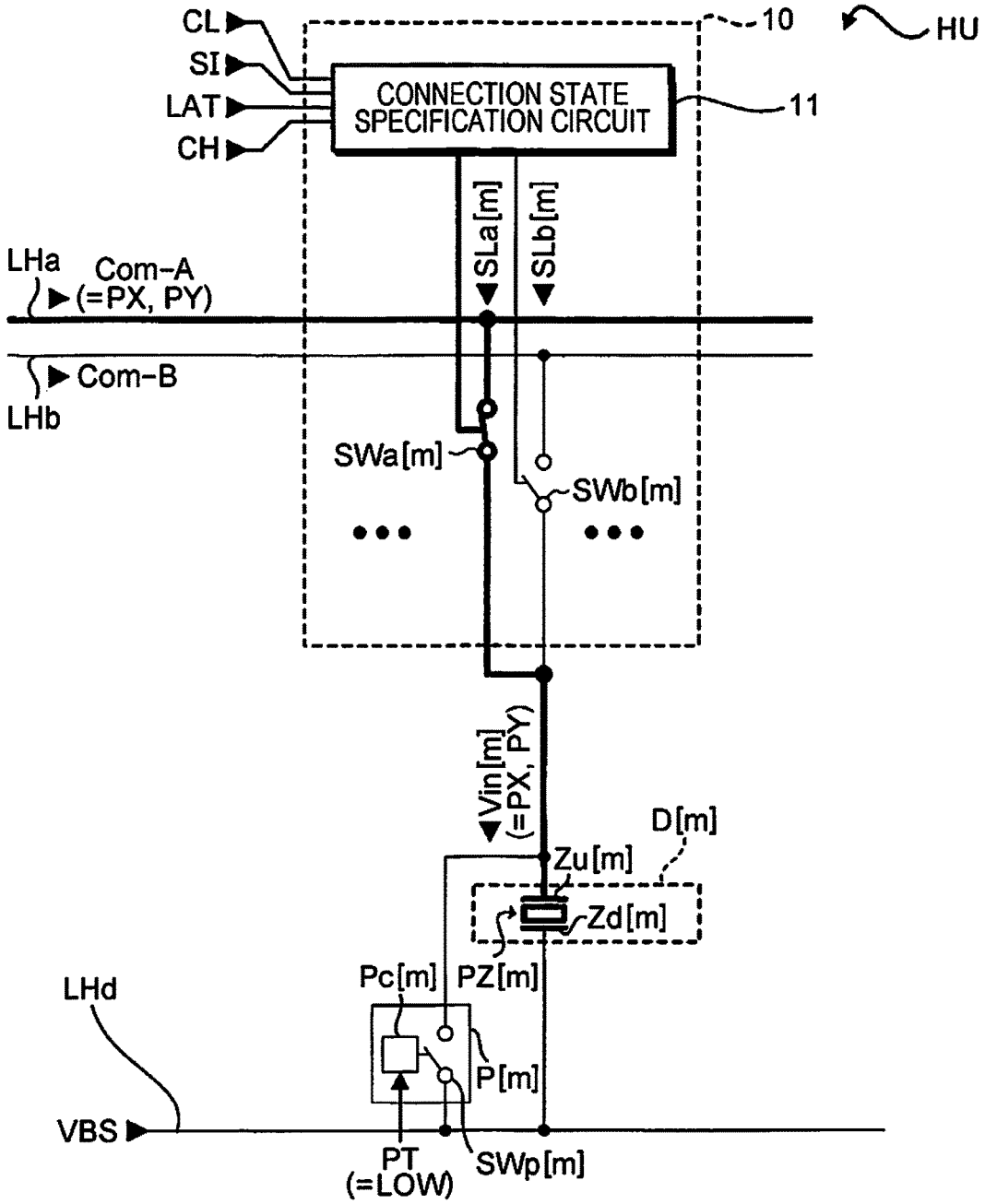
FIG. 10 is a descriptive view for explaining an example of operations of the head unit.
Figure 11:
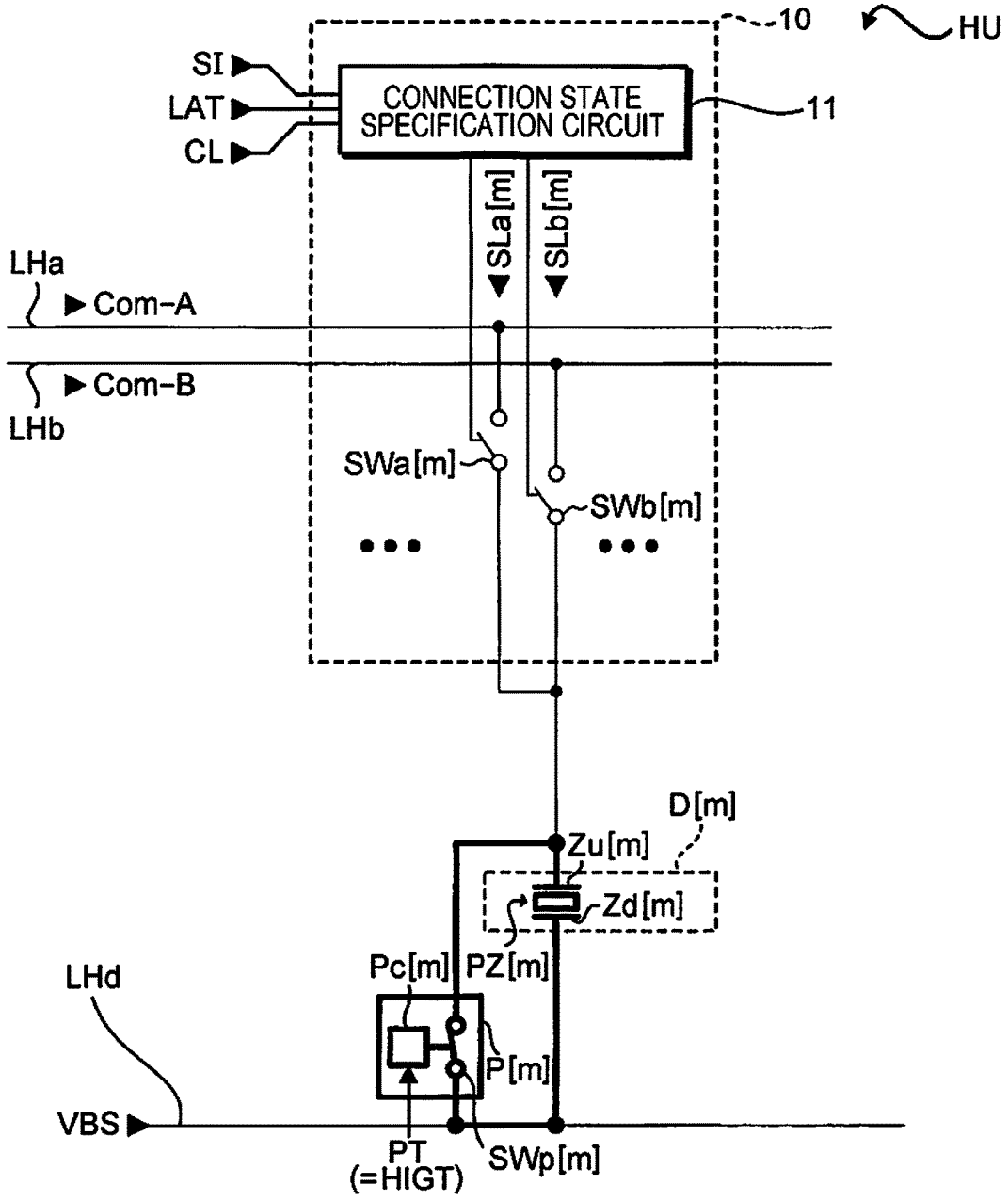
FIG. 11 is a descriptive view for explaining an example of operations of the head unit.

FIG. 10 and FIG. 11 are descriptive views for explaining an example of operations of the head unit HU. FIG. 10 and FIG. 11 illustrate one discharge portion D[m] as a representative among the M discharge portions D of each head unit HU.

FIG. 10 illustrates an example of the operations of the head unit HU in the period during printing, to be more specific, in a certain period TP (an example of a "first period") in the unit print period Tu. The period TP is the control period TP1 or TP2. The connection state specification circuit 11 sets the connection state specification signal SLa[m] to be at the high level in the period TP. With this setting, the switch SWa[m] (an example of a "first switch") is set to the ON state and the drive signal Com-A is supplied as the supply drive signal Vin[m].

In the period TP, the print determination signal PT is at the low level. Therefore, the protection control circuit Pc[m] of the protection portion P[m] set the switch SWp[m] (an example of a "second switch") to an OFF state. Since the switch SWp[m] is in the OFF state, the upper electrode Zu[m] (an example of a "first electrode") and the lower electrode Zd[m] (an example of a "second electrode") of the piezoelectric element PZ[m] are not electrically connected to each other. A predetermined voltage can thereby be applied to between the upper electrode Zu[m] and the lower electrode Zd[m].

The switch SWa[m] is set to the ON state and the switch SWp[m] is set to the OFF state in the period TP in this manner, so that the discharge portion D[m] is driven with the drive signal Com-A having the waveform PX or PY (an example of a "discharge drive waveform"). Therefore, the ink is discharged in the period TP.

FIG. 11 illustrates an example of the operations of the head unit HU in a certain period TQ (an example of a "second period") other than the period during printing. The connection state specification circuit 11 sets the connection state specification signal SLa[m] to be at the low level in the period TQ. The switch SWa[m] is thereby set to the OFF state.

The connection state specification circuit 11 also sets the connection state specification signal SLb[m] to be at the low level in the period TQ. The switch SWb[m] is also thereby set to the OFF state. The switches SWa[m] and SWb[m] are set to the OFF states, so that the upper electrode Zu[m] of the piezoelectric element PZ[m] is electrically isolated from the internal wiring LHa for supplying the drive signal Com-A and the internal wiring LHb for supplying the drive signal Com-B.

In the period TQ, the print determination signal PT is at the high level. Therefore, the protection control circuit Pc[m] of the protection portion P[m] switches ON/OFF of the switch SWp[m] in accordance with a comparison result between the potential of the upper electrode Zu[m] of the piezoelectric element PZ[m] and the potential of the lower electrode Zd[m] thereof. In the embodiment, to be specific, when the potential of the upper electrode Zu[m] is lower than the potential of the lower electrode Zd[m], that is, when the reverse-polarity electric field is applied to the piezoelectric element PZ[m], the protection control circuit Pc[m] sets the switch SWp[m] to the ON state.

FIG. 11 illustrates a state in which in the period TQ, the potential of the upper electrode Zu[m] is lower than the potential of the lower electrode Zd[m] for some reason and the protection control circuit Pc[m] sets the switch SWp[m] to the ON state. When the switch SWp[m] is set to the ON state, the upper electrode Zu[m] and the lower electrode Zd[m] of the piezoelectric element PZ[m] are electrically connected to each other.

The switches SWa[m] and SWb[m] are set to the OFF states and the switch SWp[m] is set to the ON state in the period TQ in this manner, so that the potential of the upper electrode Zu[m] is set to the same potential as the potential of the lower electrode Zd[m], to be specific, to the potential VBS. Application of the reverse-polarity electric field to the piezoelectric element PZ[m] is thereby suppressed.

5. Conclusion of First Embodiment

As described above, in the embodiment, the protection portions P can switch whether to electrically connect the upper electrodes Zu and the lower electrodes Zd to each other in accordance with the comparison results between the potentials of the upper electrodes Zu and the potentials of the lower electrodes Zd, thereby suppressing application of the reverse-polarity electric field to the piezoelectric elements PZ. Therefore, according to the embodiment, growth of the fine cracks Cr generated in the piezoelectric bodies Zm can be suppressed in the piezoelectric bodies Zm included in the piezoelectric elements PZ in comparison with a mode in which no protection portion P is provided in the head units HU, for example. Lowering of the piezoelectric characteristics of the piezoelectric bodies Zm included in the piezoelectric elements PZ and breakage thereof can be suppressed. Provision of the above-described effects is particularly preferable when the piezoelectric elements PZ including the thin-film piezoelectric bodies Zm that are easily broken are used. That is to say, the embodiment can suppress the growth of the fine cracks Cr generated in the piezoelectric bodies Zm in the thin-film piezoelectric bodies Zm, thereby reducing the possibility that the fine cracks Cr penetrate through the piezoelectric bodies Zm in the thickness direction in comparison with the mode in which no protection portion P is provided in the head units HU. Accordingly, the embodiment can increase the lifetime of the thin-film piezoelectric bodies Zm.

The protection portions P switch the switches SWp so as not to change (that is, reverse) magnitude relations (high and low relations) between the potentials of the upper electrodes Zu and the potentials of the lower electrodes Zd. With this switching, reverse of the polarity of the electric field that is applied to the piezoelectric elements PZ is suppressed, thereby suppressing application of the reverse-polarity electric field to the piezoelectric elements PZ.

Furthermore, in the embodiment, even when the reverse-polarity electric field is easily applied due to setting of the potentials of the lower electrodes Zd to the potential VBS, the protection portions P can suppress the application of the reverse-polarity electric field to the piezoelectric elements PZ.

In the embodiment, the drive signal Com-A can be supplied to the piezoelectric elements PZ for discharging the inks in the period during printing whereas application of the reverse-polarity electric field to the piezoelectric elements PZ can be suppressed in the periods other than the period during printing.

Even when the reverse-polarity electric field is applied to the piezoelectric elements PZ for a short period of time or a low reverse-polarity electric field is applied thereto in accordance with the waveform of the drive signal Com-A in the period during printing, the inks can be discharged without interruption of driving of the piezoelectric elements PZ with the drive signal Com-A.

As described above with reference to FIG. 9, the period during printing can include both of the case in which the inks are discharged from the discharge portions D and the case in which no ink is discharged. When the inks are discharged, the drive signal Com-A as the supply drive signal Vin[m] is supplied to the piezoelectric elements PZ, whereas when no ink is discharged, the drive signal Com-B as the supply drive signal Vin[m] is supplied to the piezoelectric elements PZ.

In the case in which the switches SWa and SWb of the switching circuits 10 are set to the OFF states and the drive signals Com-A and Com-B are not supplied to the upper electrodes Zu in the periods other than the period during printing, the potentials of the upper electrodes Zu are gradually lowered by natural discharge in some cases even if the piezoelectric elements PZ have been charged by previous driving. For this reason, in the periods other than the period during printing, the state in which the potentials of the upper electrodes Zu are lower than the potentials VBS of the lower electrodes Zd, that is, the state in which the reverse-polarity electric field is applied to the piezoelectric elements PZ easily occurs. Therefore, suppression of application of the reverse-polarity electric field to the piezoelectric elements PZ in the periods other than the period during printing is particularly preferable.

The drive signal Com-A or Com-B having such waveform that the piezoelectric elements PZ finely vibrate to the extent of discharging no ink may be supplied to the upper electrodes Zu if necessary in the periods other than the period during printing.

B. Variation of First Embodiment

The above-mentioned respective modes can be made to variously vary. Specific variations are described below. Two or more modes that are desirably selected from the following examples can be appropriately combined within a consistent range. In the following variations, reference numerals referred to in the above description denote elements having equivalent actions and functions to those in the embodiment, and a detail description thereof is appropriately omitted.

First Variation

In the above-described embodiment, when the condition that the potentials of the upper electrodes Zu of the piezoelectric elements PZ are lower than the potentials of the lower electrodes Zd thereof is satisfied, the switches SWp of the protection portions P are set to the ON states. In a first variation of the first embodiment, when the condition that the state in which the potentials of the upper electrodes Zu are lower than the potentials of the lower electrodes Zd lasts for a predetermined time length is satisfied in addition to the above-described condition, the switches SWp are set to the ON states.

Figure 12:
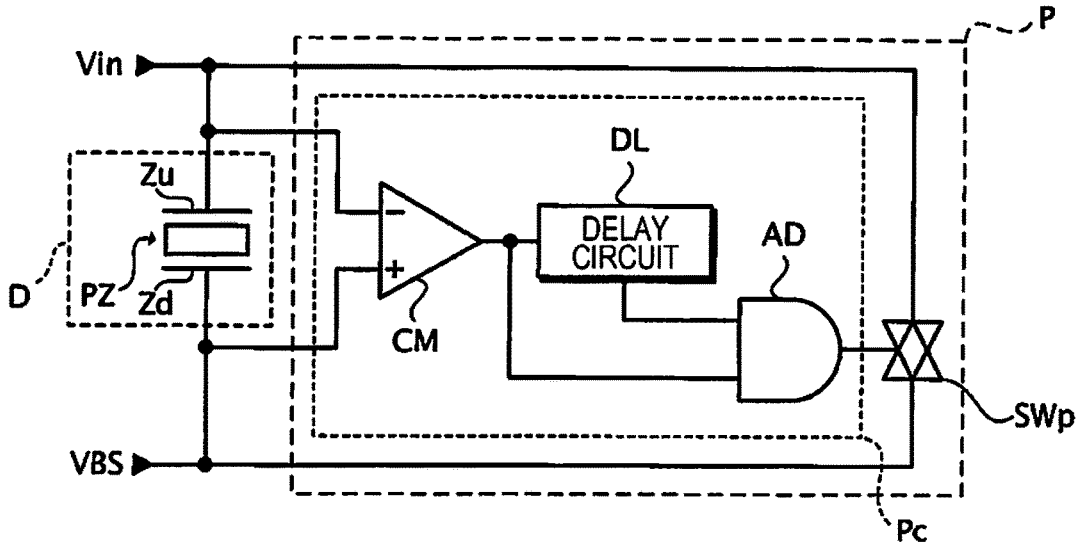
FIG. 12 is a diagram illustrating an example of the configurations of a switch and a protection control circuit of a protection portion according to a first variation of the first embodiment.

FIG. 12 is a diagram illustrating an example of the configurations of the switch SWp and the protection control circuit Pc of the protection portion P according to the first variation. Each protection control circuit Pc in the variation includes the comparator CM, the AND circuit AD, and a delay circuit DL (an example of "delay unit").

In the same manner as the above-described embodiment, the input terminals of the comparator CM are electrically connected to the upper electrode Zu and the lower electrode Zd of the piezoelectric element PZ. An output signal of the comparator CM is at a low level when the potential of the upper electrode Zu is higher than the potential of the lower electrode Zd, whereas the output signal is at a high level when the potential of the upper electrode Zu is lower than the potential of the lower electrode Zd. In the variation, the output signal of the comparator CM is referred to as a potential comparison signal in some cases.

The potential comparison signal is input to one input terminal of the AND circuit after passing through the delay circuit DL, and the potential comparison signal is input to the other input terminal of the AND circuit without passing through the delay circuit DL.

The delay circuit DL delays the potential comparison signal at certain timing (referred to as "first timing") to timing (referred to as "second timing") a predetermined time length (an example of a "first time length") after the first timing.

An output signal of the AND circuit AD is at a high level when both of the potential comparison signal (an example of a "first signal") after passing through the delay circuit DL, that is, the potential comparison signal delayed to the second timing, and the potential comparison signal without passing through the delay circuit DL, that is, the potential comparison signal (an example of a "second signal") at the second timing indicate that the potential of the upper electrode Zu is lower than the potential of the lower electrode Zd. The output signal of the AND circuit AD is at a low level in cases other than the above-described case. The output signal of the AND circuit AD is supplied to the switch SWp as a control signal for controlling ON/OFF of the switch SWp.

Accordingly, when both of the potential comparison signal delayed to the second timing and the potential comparison signal at the second timing indicate that the potential of the upper electrode Zu is lower than the potential of the lower electrode Zd, the protection controller Pc sets the switch SWp to an ON state. The protection controller Pc sets the switch SWp to an OFF state in the cases other than the above-described case.

When both of the potential comparison signal delayed to the second timing and the potential comparison signal at the second timing indicate that the potential of the upper electrode Zu is lower than the potential of the lower electrode Zd, it can be determined that the state in which the potential of the upper electrode Zu is lower than the potential of the lower electrode Zd lasts for the above-described predetermined time length from the first timing to the second timing. That is to say, in such a case, it can be determined that the reverse-polarity electric field is applied to the piezoelectric element PZ for the predetermined time length.

In this variation, when the protection controller Pc sets the switch SWp to the ON state in the above-described case, the upper electrode Zu and the lower electrode Zd are electrically connected to each other after the timing at which the switch SWp is set to the ON state. Therefore, application of the reverse-polarity electric field to the piezoelectric element PZ for such an excessively long period of time as to exceed the predetermined time length can be suppressed.

In other words, when the reverse-polarity electric field is not applied, or when an application period is shorter than the predetermined time length even if the reverse-polarity electric field is applied, the protection controller Pc sets the switch SWp to the OFF state to thereby keep a state in which a predetermined voltage can be applied to between the upper electrode Zu and the lower electrode Zd.

A time length appropriate for the predetermined time length, that is, a time length defining an allowable degree of the time length for which the reverse-polarity electric field is applied can be set based on an experiment, for example.

In this variation, the reverse-polarity electric field is applied to the piezoelectric element PZ for only a short period of time at the allowable degree in the period during printing in which printing is normally performed. Therefore, the switch SWp is set to the OFF state and the ink can be discharged without interruption of driving of the piezoelectric element PZ. Even in the period during printing or in the periods other than the period during printing, when some abnormality (for example, fluctuation of the potential VBS) occurs and the reverse-polarity electric field is applied to the piezoelectric element PZ for the predetermined time length, the switch SWp is set to the ON state. With this configuration, application of the reverse-polarity electric field to the piezoelectric element for an excessively longer period of time can be suppressed.

In the first variation, the protection control circuit Pc included in each protection portion P controls ON/OFF of the switch SWp without using the print determination signal PT indicating whether the current time is in the period during printing. However, also in the first variation, the protection control circuit Pc may control ON/OFF of the switch SWp based on the print determination signal PT. That is to say, the operation of setting the switch SWp to the ON state may be performed only in the periods other than the period during printing in a limited manner.

2. Second Variation

In the above-described embodiment, when the potentials of the upper electrodes Zu of the piezoelectric elements PZ are lower than the potentials of the lower electrodes Zd thereof, the switches SWp of the protection portions P are set to the ON states. In a second variation of the first embodiment, when the potentials of the upper electrodes Zu are lower than a predetermined potential that is set to be lower than the potentials of the lower electrodes Zd, the switches SWp are set to the ON state.

Figure 13:
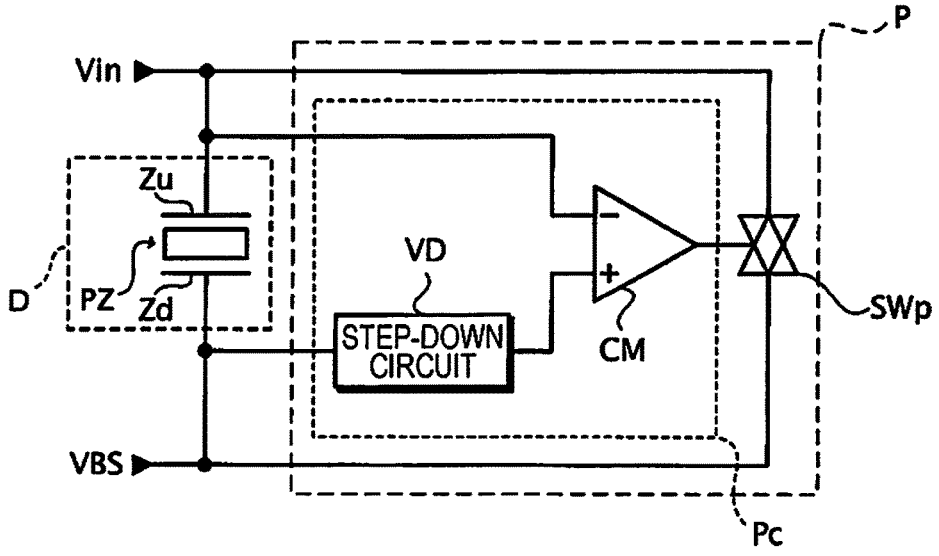
FIG. 13 is a diagram illustrating an example of the configurations of a switch and a protection control circuit of a protection portion according to a second variation of the first embodiment.

FIG. 13 is a diagram illustrating an example of the configurations of the switch SWp and the protection control circuit Pc of the protection portion P according to the second variation. Each protection control circuit Pc in the variation includes the comparator CM and a step-down circuit VD.

One input terminal of the comparator CM is electrically connected to the upper electrode Zu of the piezoelectric element PZ. The other input terminal of the comparator CM is electrically connected to the lower electrode Zd of the piezoelectric element PZ with the step-down circuit VD interposed therebetween. A step-down potential (an example of a "second potential") that is output from the step-down circuit VD is lower than a potential of the lower electrode Zd that is input to the step-down circuit VD, that is, the potential VBS.

When the potential of the upper electrode Zu is higher than the above-described step-down potential, the output signal of the comparator CM is at a low level, whereas when the potential of the upper electrode Zu is lower than the above-described step-down potential, the output signal of the comparator CM is at a high level. The output signal of the comparator CM is supplied to the switch SWp as a control signal for controlling ON/OFF of the switch SWp.

Accordingly, the protection controller Pc sets the switch SWp to the ON state when the potential of the upper electrode Zu is lower than the above-described step-down potential, whereas the protection controller Pc sets the switch SWp to the OFF state when the potential of the upper electrode Zu is higher than the above-described step-down potential.

The step-down potential is set to be lower than the potential VBS. Therefore, a state in which the potential of the upper electrode Zu is lowered to be identical to the step-down potential is a state in which the reverse-polarity electric field corresponding to a voltage difference between the step-down potential and the potential VBS of the lower electrode Zd is applied to the piezoelectric element PZ.

In the variation, when the potential of the upper electrode Zu is lower than the step-down potential, the protection controller Pc sets the switch SWp to the ON state. With this configuration, application, to the piezoelectric element PZ, of such an excessively high reverse-polarity electric field as to exceed the reverse-polarity electric field corresponding to the voltage difference can be suppressed.

In other words, when the reverse-polarity electric field is not applied or when an applied reverse-polarity electric field is lower than the reverse-polarity electric field corresponding to the voltage difference even if the reverse-polarity electric field is applied, the protection controller Pc sets the switch SWp to the OFF state to thereby keep a state in which a predetermined voltage can be applied to between the upper electrode Zu and the lower electrode Zd.

A potential appropriate for the step-down potential, that is, a potential defining an allowable degree of intensity of the reverse-polarity electric field can be set based on an experiment, for example.

In this variation, only a low reverse-polarity electric field at the allowable degree is applied to the piezoelectric element PZ in the period during printing in which printing is normally performed. Therefore, the switch SWp is set to the OFF state and the ink can be discharged without interruption of driving of the piezoelectric element PZ. Even in the period during printing or in the periods other than the period during printing, when some abnormality (for example, fluctuation of the potential VBS) occurs and the potential of the upper electrode Zu becomes lower, than the step-down potential, the switch SWp is set to the ON state. With this configuration, application of an excessively high reverse-polarity electric field to the piezoelectric element PZ can be suppressed.

Application of an excessively high reverse-polarity electric field to the piezoelectric element PZ may be suppressed with a mode in which when a boosted potential obtained by boosting the potential of the upper electrode Zu becomes lower than the potential of the lower electrode Zd, the switch SWp is set to the ON state. However, boosting of the potential of the upper electrode Zu is not preferable in terms of increase in power consumption and lowering of safety. The above-described configuration in which the potential of the lower electrode Zd is stepped down is therefore more preferable.

In the second variation, the protection control circuit Pc included in each protection portion P controls ON/OFF of the switch SWp without using the print determination signal PT indicating whether the current time is in the period during printing. However, also in the second variation, the protection control circuit Pc may control ON/OFF of the switch SWp based on the print determination signal PT. That is to say, the operation of setting the switch SWp to the ON state may be performed only in the periods other than the period during printing in a limited manner.

The protection control circuit Pc may include a determination unit that determines whether the current time is in the period during printing and outputs the print determination signal PT in the mode in which the protection control circuit Pc controls ON/OFF of the switch SWp based on the print determination signal PT. The determination unit generates the print determination signal PT based on, for example, the print signal SI, the waveform specification signal dCom, the latch signal LAT, and the like.

C. Second Embodiment

Hereinafter, a second embodiment of the invention will be described. In the following modes and variations, reference numerals used in the first embodiment denote elements having similar actions and functions to those in the first embodiment and a detail description thereof is appropriately omitted.

In the above-described first embodiment, the protection portions P are provided in order to suppress application of the reverse-polarity electric field to the piezoelectric elements PZ. In the second embodiment, application of the reverse-polarity electric field to the piezoelectric elements PZ can be suppressed without providing the protection portions P.

Figure 14:
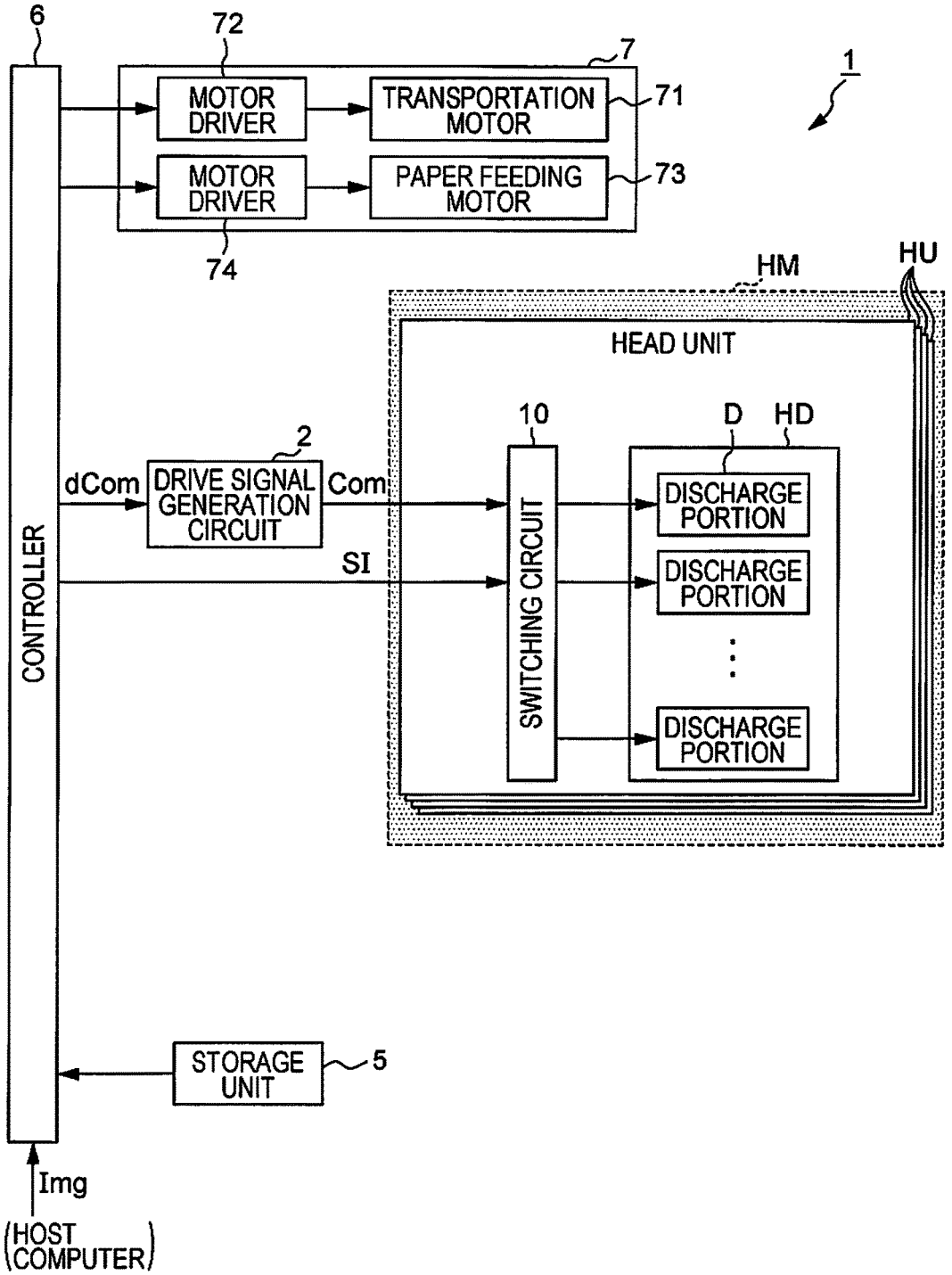
FIG. 14 is a block diagram illustrating an example of the configuration of an ink jet printer according to a second embodiment.

FIG. 14 is a block diagram illustrating an example of the configuration of an ink jet printer 1 according to the second embodiment. The second embodiment is different from the first embodiment in the point that head units HU include no protection portion P. The recording heads HD and the switching circuits 10 have similar configurations to those in the first embodiment.

Figure 15:
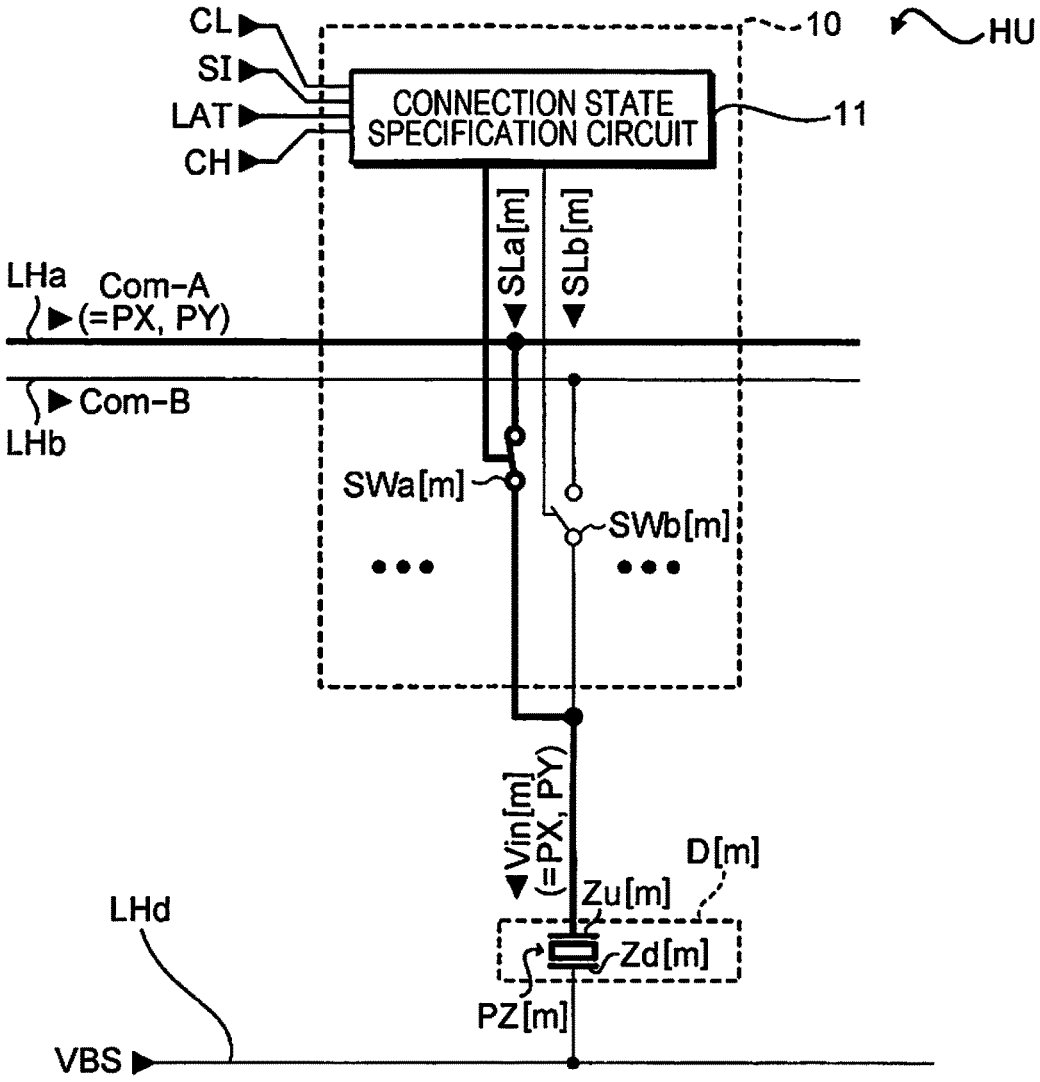
FIG. 15 is a descriptive view for explaining an example of operations of a head unit according to the second embodiment.
Figure 16:
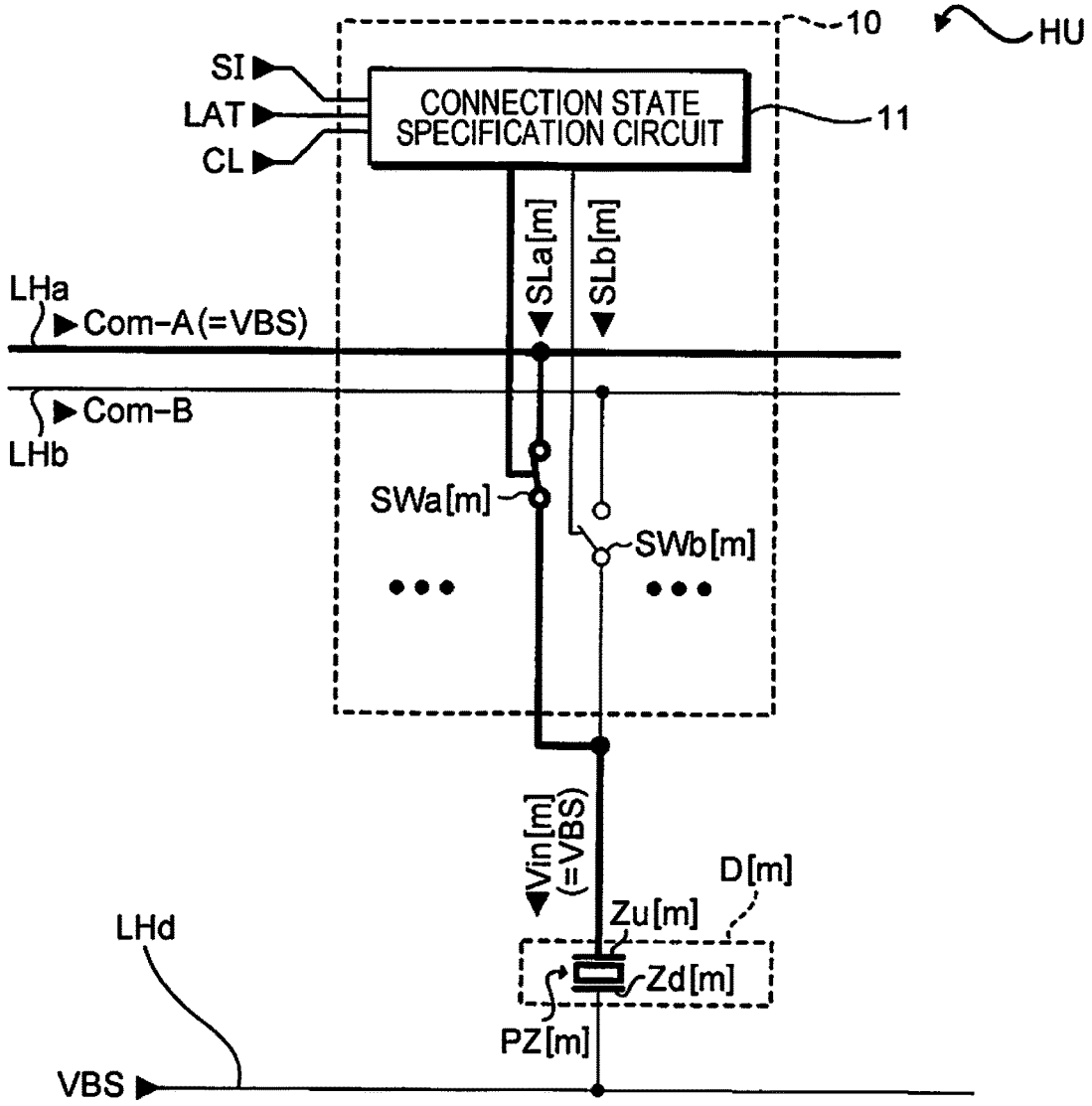
FIG. 16 is a descriptive view for explaining an example of operations of the head unit according to the second embodiment.

Operations of each head unit HU will be described with reference to FIG. 15 and FIG. 16. FIG. 15 and FIG. 16 are descriptive views for explaining an example of the operations of the head unit HU and illustrate, as a representative, one discharge portion D[m] among the M discharge portions D of each head unit HU.

In the embodiment, no protection portion P[m] corresponding to the discharge portion DM is provided. Therefore, a state in which the upper electrode Zu[m] and the lower electrode Zd[m] of the piezoelectric element PZ[m] included in the discharge portion D[m] are electrically isolated from each other is kept in the operations of the head unit HU.

FIG. 15 illustrates an example of the operations of the head unit HU in a period during printing, to be more specific, in a certain period TP (an example of a "first period") in the unit print period Tu. The period TP is the control period TP1 or TP2. The operations of the head unit HU in the period TP are the same as those in the first embodiment.

That is to say, the connection state specification circuit 11 sets the connection state specification signal SLa[m] to be at the high level, so that the switch SWa[m] (an example of a "first switch") is set to the ON state and the drive signal Com-A is supplied as the supply drive signal Vin[m]. The discharge portion D[m] is thereby driven with the drive signal Com-A having the waveform PX or PY (an example of a "discharge drive waveform") to discharge ink.

FIG. 16 illustrates an example of the operations of the head unit HU in a certain period TQ (an example of a "second period") other than the period during printing. In the period TQ, the drive signal generation circuit 2 sets the potential of the drive signal Com-A to the potential VBS, that is, the same potential as the potential of the lower electrode Zd[m] of the piezoelectric element PZ[m]. Furthermore, in the period TQ, the connection state specification circuit 11 sets the connection state specification signal SLa[m] to be at the high level. With these settings, the switch SWa[m] is set to the ON state, the drive signal Com-A is supplied as the supply drive signal Vin[m], and the potential of the upper electrode Zu[m] of the piezoelectric element PZ[m] is set to the potential VBS.

The potential of the drive signal Com-A is set to be the same potential as the potential VBS of the lower electrode Zd[m] and the switch SWa[m] is set to the ON state in the period TQ in this manner, so that the potential of the upper electrode Zu[m] and the potential of the lower electrode Zd[m] are set to be the same potential, that is, the potential VBS. In the embodiment, application of the reverse-polarity electric field to the piezoelectric element PZ[m] can be suppressed in this manner.

In the period TQ, the potential of the drive signal Com-B may be set to the same potential as the potential VBS of the lower electrode Zd[m], the switch SWb[m] may be set to the ON state, and the drive signal Com-B may be supplied as the supply drive signal Vin[m]. Even with this mode, the potential of the upper electrode Zu[m] and the potential of the lower electrode Zd[m] can be set to be the same potential, that is, the potential VBS, thereby suppressing application of the reverse-polarity electric field to the piezoelectric element PZ[m].

D. Other Variations

The above-described embodiments and variations can be further made to variously vary. For example, although the drive signal Com has two systems of signals including the drive signal Com-A and the drive signal Com-B in the above-described embodiments and variations, the invention is not limited to this kind of mode. The drive signal Com may have at least one system of signals.

In the mode in which the drive signal Com has the two systems of signals, the waveform of the drive signal Com-A and the waveform of the drive signal Com-B are not limited to those illustrated in FIG. 8 and various waveforms may be set if needed.

For example, in the above-described embodiments and variations, when the potentials of the upper electrodes Zu of the piezoelectric elements PZ are higher than the potentials of the lower electrodes Zd thereof, the same-polarity electric field is applied to the piezoelectric bodies Zm. However, a mode in which when the potentials of the upper electrodes Zu of the piezoelectric elements PZ are lower than the potentials of the lower electrodes Zd thereof, the same-polarity electric field is applied to the piezoelectric bodies Zm may be employed if needed.

Furthermore, in the above-described embodiments and variations, the four head units HU and the four ink cartridges 31 are provided in the one-to-one correspondence manner in the ink jet printer 1, for example. However, the invention is not limited to this mode and it is sufficient that the ink jet printer 1 includes one or more head units HU and one or more ink cartridges 31.

Moreover, in the above-described embodiments and variations, the ink jet printer 1 is a serial printer, for example. However, the invention is not limited to this mode and the ink jet printer 1 may be a so-called line printer in which the plurality of nozzles N are provided so as to extend to be wider than the width of the recording paper PP in the head module HM.

In the above-described embodiments and variations, the drive signal Com is supplied to the upper electrodes Zu of the piezoelectric elements PZ and the potential VBS is supplied to the lower electrodes Zd, for example. However, the invention is not limited to this mode and the potential VBS may be supplied to the upper electrodes Zu of the piezoelectric elements PZ and the drive signal Com may be supplied to the lower electrodes Zd.

What is claimed is:

1. A liquid discharge apparatus comprising:

a piezoelectric element that has a first electrode, a piezoelectric body, and a second electrode;

a first switch that is capable of switching whether to supply a drive signal for driving the piezoelectric element to the first electrode; and a second switch that is arranged electrically in parallel with the piezoelectric element and is capable of switching whether to electrically connect the first electrode and the second electrode to each other.

2. The liquid discharge apparatus according to claim 1, wherein the piezoelectric element is formed as a polycrystal body and is subject to poling.

3. The liquid discharge apparatus according to claim 1, wherein the second switch switches whether to electrically connect the first electrode and the second electrode to each other so as not to change a magnitude relation between a potential of the first electrode and a potential of the second electrode.

4. The liquid discharge apparatus according to claim 1, wherein a potential of the second electrode is set to be a first potential that is higher than a ground potential.

5. The liquid discharge apparatus according to claim 1, wherein the second switch electrically connects the first electrode and the second electrode to each other when a potential of the first electrode is lower than a potential of the second electrode.

6. The liquid discharge apparatus according to claim 5, wherein the second switch electrically connects the first electrode and the second electrode to each other when a state in which the potential of the first electrode is lower than the potential of the second electrode lasts for a first time length.

7. The liquid discharge apparatus according to claim 6, further including a delay unit that delays a first signal indicating whether the potential of the first electrode is lower than the potential of the second electrode at first timing to second timing the first time length after the first timing, wherein the second switch electrically connects the first electrode and the second electrode to each other when both of the first signal delayed to the second timing and a second signal indicating whether the potential of the first electrode is lower than the potential of the second electrode at the second timing indicate that the potential of the first electrode is lower than the potential of the second electrode.

8. The liquid discharge apparatus according to claim 5, wherein the second switch electrically connects the first electrode and the second electrode to each other when the potential of the first electrode is set to be lower than a second potential that is set to be lower than the potential of the second electrode.

9. The liquid discharge apparatus according to claim 1, further including a comparison unit that compares a potential of the first electrode and a potential of the second electrode, wherein the second switch switches whether to electrically connect the first electrode and the second electrode to each other in accordance with a comparison result by the comparison unit.

10. The liquid discharge apparatus according to claim 1, wherein in a first period, a waveform for driving the piezoelectric element is set to the drive signal, the first switch is set to be in a state of supplying the drive signal to the first electrode, and the second switch is set to be in a state of electrically disconnecting the first electrode and the second electrode from each other, and in a second period other than the first period, the first switch is set to be in a state of supplying no drive signal to the first electrode, and the second switch is set to be in a state of electrically connecting the first electrode and the second electrode to each other.

11. The liquid discharge apparatus according to claim 1, wherein discharge portions that include piezoelectric elements using thin-film piezoelectric bodies and are capable of discharging liquid are aligned with a density of equal to or higher than 300 dpi.

12. A print head comprising:

a piezoelectric element that has a first electrode, a piezoelectric body, and a second electrode;

a first switch that is capable of switching whether to supply a drive signal for driving the piezoelectric element to the first electrode; and a second switch that is arranged electrically in parallel with the piezoelectric element and is capable of switching whether to electrically connect the first electrode and the second electrode to each other.

13. The print head according to claim 12, wherein the piezoelectric element is formed as a polycrystal body and is subject to poling.

14. The print head according to claim 12, wherein the second switch switches whether to electrically connect the first electrode and the second electrode to each other so as not to change a magnitude relation between a potential of the first electrode and a potential of the second electrode.

15. The print head according to claim 12, wherein a potential of the second electrode is set to be a first potential that is higher than a ground potential.

16. The print head according to claim 12, wherein the second switch electrically connects the first electrode and the second electrode to each other when a potential of the first electrode is lower than a potential of the second electrode.

17. The print head according to claim 12, further including a comparison unit that compares a potential of the first electrode and a potential of the second electrode, wherein the second switch switches whether to electrically connect the first electrode and the second electrode to each other in accordance with a comparison result by the comparison unit.

* * * * *